US009504337B2

(12) United States Patent
Workman

(10) Patent No.: US 9,504,337 B2
(45) Date of Patent: Nov. 29, 2016

(54) ERGONOMIC TWIN BABY CARRIER

(71) Applicant: Krystal Workman, Falls Church, VA (US)

(72) Inventor: Krystal Workman, Falls Church, VA (US)

( * ) Notice: Subject to any disclaimer, the term of this patent is extended or adjusted under 35 U.S.C. 154(b) by 57 days.

(21) Appl. No.: 14/243,869

(22) Filed: Apr. 2, 2014

(65) Prior Publication Data

US 2015/0282638 A1 Oct. 8, 2015

Related U.S. Application Data

(63) Continuation-in-part of application No. 13/758,963, filed on Feb. 4, 2013, now Pat. No. 9,439,516.

(60) Provisional application No. 61/595,069, filed on Feb. 4, 2012.

(51) Int. Cl.
*A47D 13/02* (2006.01)

(52) U.S. Cl.
CPC ..... *A47D 13/025* (2013.01)

(58) Field of Classification Search
CPC ..... A47D 13/025; A45F 3/04; A45F 3/047; A45F 2003/025; A45F 2003/045; A41D 2400/482
USPC ..... 224/158–160, 578–580
See application file for complete search history.

(56) References Cited

U.S. PATENT DOCUMENTS 3,229,873 A * 1/1966 Hershman ..... A47D 13/025 224/160
4,009,808 A * 3/1977 Sharp ..... A47D 13/025 224/160
4,402,440 A 9/1983 Purtzer et al.
4,428,514 A 1/1984 Elf
4,469,259 A 9/1984 Krich et al.
D275,812 S 10/1984 Deacon (Continued)

FOREIGN PATENT DOCUMENTS

FR 2556574 A1 6/1985
GB 1560260 A 1/1980

(Continued)

OTHER PUBLICATIONS

"Twin Baby Carriers." Retrieved from the Internet Dec. 4, 2011. URL: http://www.twin-pregnancy-and-beyond.com/twin-baby-carriers.html.

(Continued)

*Primary Examiner* — Adam Waggenspack
(74) *Attorney, Agent, or Firm* — Symbus Law Group, LLC; Clifford D. Hyra

(57) ABSTRACT

A child carrier for carrying two children of the same or different sizes has a first and second child carrier portions including first and second carrier pouches, respectively, each pouch attached at its bottom to a waist support, and shoulder straps. The first and second child carrier portions are configured to be secured between the shoulder straps and directly opposite one another. At least one of the child carrier pouches is configured to extend behind the shoulder straps, such that a heavy weight in the opposite child carrier pouch that presses the shoulder straps tightly against a wearer does not compress a child therein against the wearer. Each of the child carrier pouches is curved towards a wearer to prevent a child inserted therein from facing away from the wearer and is configured to hold a child in a seated straddle position.

19 Claims, 17 Drawing Sheets

(56) References Cited

U.S. PATENT DOCUMENTS

| | | | | |
|---|---|---|---|---|
| D307,821 | S | 5/1990 | Fallon | |
| 5,289,959 | A | 3/1994 | Beeley et al. | |
| 5,454,498 | A | 10/1995 | Dunn et al. | |
| 5,522,528 | A | 6/1996 | Petricola | |
| 5,678,739 | A | 10/1997 | Darling et al. | |
| 5,685,466 | A * | 11/1997 | Hsieh | A47D 13/025 224/159 |
| 5,799,851 | A | 9/1998 | Wulf et al. | |
| 7,766,199 | B1 * | 8/2010 | Caperon | A47D 13/025 224/158 |
| 8,590,757 | B2 * | 11/2013 | Frost | A47D 13/025 224/159 |
| 8,636,181 | B2 | 1/2014 | Gunter et al. | |
| 2004/0031827 | A1 | 2/2004 | Haber | |
| 2004/0065708 | A1 * | 4/2004 | Amram | A45F 3/047 224/579 |
| 2004/0149790 | A1 | 8/2004 | Kassai et al. | |
| 2006/0261104 | A1 * | 11/2006 | Zambrzycki | A47D 13/025 224/158 |
| 2007/0029356 | A1 | 2/2007 | Moriguchi et al. | |
| 2007/0228091 | A1 * | 10/2007 | Shawen | A45C 15/00 224/153 |
| 2009/0206116 | A1 | 8/2009 | Grant | |
| 2011/0290831 | A1 * | 12/2011 | Wang | A47D 13/025 224/160 |
| 2013/0327796 | A1 | 12/2013 | Poiani | |

FOREIGN PATENT DOCUMENTS

| | | | |
|---|---|---|---|
| JP | 2009207848 | A | 9/2009 |
| JP | 2010029290 | A | 2/2010 |

OTHER PUBLICATIONS

Maximom Baby Carrier for Twins. Retrieved from the Internet Dec. 4, 2011. URL: http://www.the-baby-boutique.com/maximomtwincarrier.html.

Review and description of the TwinTrexx baby carrier, from the webpage www.breastfeedingquest.com/twin-carrier.html (retrieved on Feb. 20, 2015).

Online article with a review of the TwinTrexx baby carrier, dated Aug. 8, 2011, from the webpage http://www.playdatecrashers.com/2011/08/twintrexx-carrier/ (retrieved on Feb. 2, 2015).

Advertisement and description/photos for the MaxiMom Baby Carrier, Apr. 6, 2005, from the webpage www.tottenders.com/page2.html (retrieved using the Internet Archive Wayback Machine on Feb. 16, 2015).

* cited by examiner

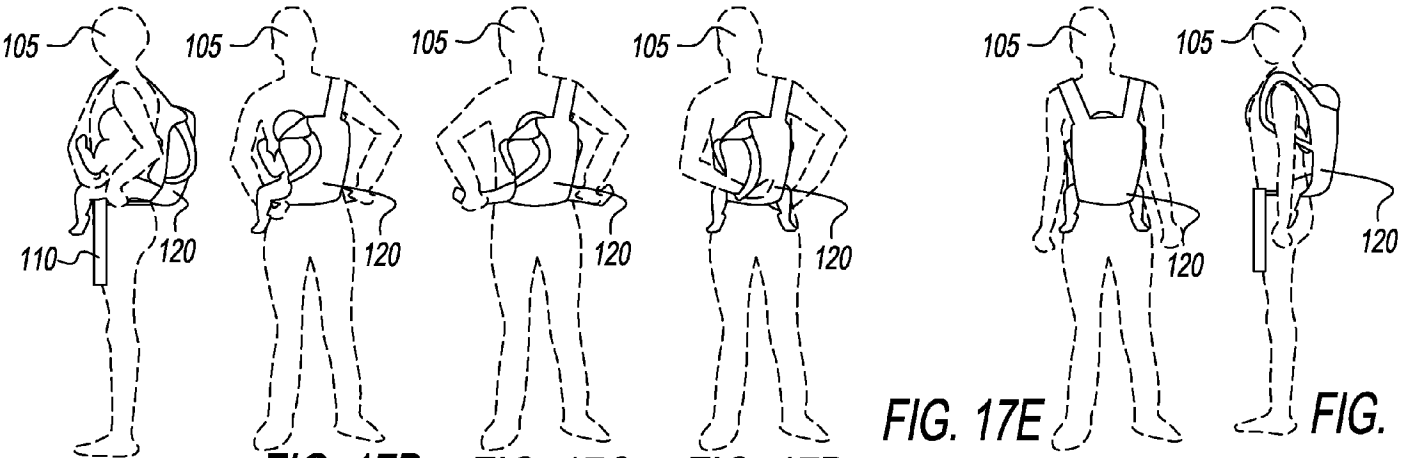
FIG. 17A
FIG. 17B
FIG. 17C
FIG. 17D
FIG. 17E
FIG. 17F
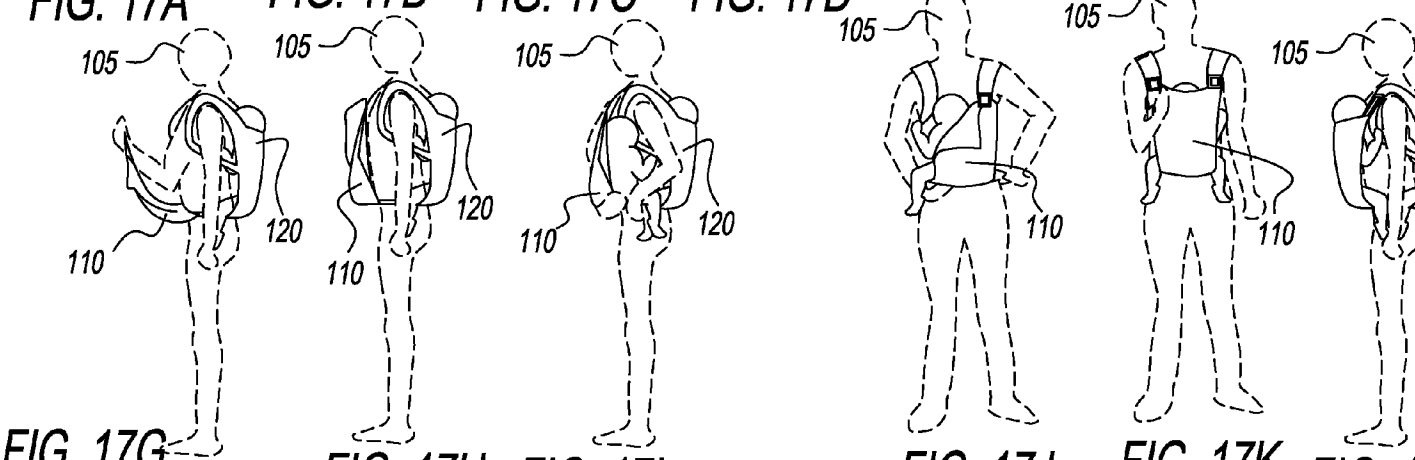
FIG. 17G
FIG. 17H
FIG. 17I
FIG. 17J
FIG. 17K
FIG. 17L

ERGONOMIC TWIN BABY CARRIER

The present application is a continuation-in-part of U.S. application Ser. No. 13/758,963, filed Feb. 4, 2013, which claims the benefit of U.S. Provisional Application No. 61/595,069, filed Feb. 4, 2012, which are hereby incorporated by reference in their entirety.

BACKGROUND OF THE INVENTION

A child or baby carrier is a device used to carry an infant or small child on the body of another person who wears the device, typically an adult. Such devices take various forms, including baby slings, wraps, backpack carriers and hip carriers. These devices have varying materials, decoration and degrees of rigidity and support for the child or baby and wearer. Existing carriers are primarily designed for holding a single child. Multiple-child carriers are generally poorly designed and lead to rapid fatigue and discomfort for the children and adult.

Needs exist for improved carriers for holding two children at once.

SUMMARY OF THE INVENTION

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description. Rather, the scope of the invention is defined by the appended claims.

In certain embodiments, the disclosed embodiments may include one or more of the features described herein. Embodiments disclosed herein describe a soft structured and/or frameless apparatus with a front carrier pouch in combination with a back carrier pouch. More so, embodiments described herein allow for a first child disposed in the front carrier pouch to be seated up-right, face inward (towards the wearer), and be seated in a straddled or balled position, and allow for a second child disposed in the back carrier pouch to be seated up-right, face inward (towards the wearer), and be seated in a straddled or balled position.

Example embodiments herein disclose a baby carrier comprising a first carrier pouch disposed in back of a wearer configured to carry a first child, and a second carrier pouch disposed in front of the wearer configured to carry a second child, wherein the first child and the second child face the wearer.

Within further example embodiments, the second carrier pouch is configured to be removed from the baby carrier if not in use.

In another example embodiment, the first carrier pouch includes a first set of shoulder straps, and the second carrier pouch includes a second set of shoulder straps, and the first set of shoulder straps and the second set of shoulder straps are configured to respectively adjust the shape of the first carrier pouch and the second carrier pouch.

In another example embodiment, the second carrier pouch may be rolled into a tubular structure.

A further example embodiment may include a first waist support corresponding to the first carrier pouch, and a second waist support corresponding to the second carrier pouch, wherein the first and second waist supports may be independently adjusted to modify the shape of the first carrier pouch and the second carrier pouch, respectively.

A new child carrier system for simultaneously carrying two children of different sizes in a first aspect includes a first child carrier portion having a first carrier pouch attached at its bottom to a waist support, a second child carrier portion having a second carrier pouch attached at its bottom to the waist support, and shoulder straps. The first child carrier portion and the second child carrier portion are configured to be secured to and between the shoulder straps and to be directly opposite one another when both are secured to the shoulder straps. At least one of the first child carrier pouch and the second child carrier pouch is configured to extend behind the shoulder straps, such that a heavy weight in the opposite child carrier that presses the shoulder straps tightly against a wearer does not compress a child therein against the wearer. Each of the first and second carrier pouches is curved towards a wearer to prevent a child inserted therein from facing away from the wearer and is configured to hold a child in a seated straddle position. The second child carrier portion is configured for complete removal from the shoulder straps and for attachment to second shoulder straps independent of the child carrier portions to create an independent child carrier. Thus, the two child carrier portions may be attached to the same shoulder straps to create a single, two-child carrier capable of carrying children of significantly different size, or one child carrier portion may be attached to the shoulder straps and the second child carrier portion attached to second shoulder straps to create two separate child carriers.

Many variations are encompassed by this embodiment. Each set of shoulder straps may be complete loops without any carrier portion attached, or may form complete loops only when attached to one or to both carrier portions. For example, in one embodiment a first set of shoulder straps is permanently attached to one carrier portion and forms full loops in combination with that carrier portion, and the second set of shoulder straps is removably attached to the other carrier portion, forming full loops only when attached to that second carrier portion. At least one of the sets of shoulder straps is configured for attachment to both carrier portions, but the other set of shoulder straps may be configured for attachment to only one or two both carrier portions. In some embodiments, the two sets of shoulder straps are identical. For example, each set of shoulder straps may form complete loops independent of any attached carrier portion and be configured for attachment to both carrier portions, so that each set of shoulder straps may be used with a single or with both carrier portions. In some embodiments, the two sets of shoulder straps connect to each other to form a single, two-child carrier, and in some such embodiments only one carrier portion can connect directly to each set of shoulder straps. Connections between carrier portions and shoulder straps and/or between sets of shoulder straps (and in fact all connections described herein, including waist band connections, etc.) may be made by any known method of fastening and/or securing, for example clips, snaps, rings, tying, permanent attachment such as stitching, etc.

In another aspect, each of the first and second carrier pouches has a flexible material that causes a child inserted therein to sit low against the waist support and that presses against the back of the child to press the child against the wearer when a wearer has the waist support secured around the wearer's waist and the shoulder straps over the wearer's shoulders, thereby directing the child's weight to the wearer's hips.

In another aspect, the waist support includes a first waist support section attached to the bottom of the first carrier pouch and a second waist support section attached to the bottom of the second carrier pouch, the first waist support section and the second waist support section are configured to be fastened together to form a single, adjustable waist band, the first carrier pouch and first waist support section are configured for reducing the effective size of the first carrier pouch, independently of the second carrier pouch, by wrapping a portion of the first carrier pouch around the first waist support section, and the second carrier pouch and second waist support section are configured for reducing the effective size of the second carrier pouch, independently of the first carrier pouch, by wrapping a portion of the second carrier pouch around the second waist support section.

In another aspect, the first carrier pouch is configured to be secured to the shoulder straps at least in part by first adjustment straps and the second carrier pouch is configured to be secured to the shoulder straps at least in part by second adjustment straps, and the first adjustment straps are configured to be loosened or tightened to loosen or tighten the first carrier pouch against the body of a wearer and the second adjustment straps are configured to be loosened or tightened to loosen or tighten the second carrier pouch against the body of the wearer.

In another aspect, the second child carrier portion is configured for complete removal from the shoulder straps and from the first child carrier portion, and the first waist support section includes ends configured to be secured to each other to form an adjustable waist band without fastening to the second waist support section.

In another aspect, the carrier includes a chest strap connecting the shoulder straps. In another aspect, the chest strap is adjustable.

In another aspect, the first carrier pouch includes an inner layer connected to an outer layer, and the first carrier pouch is configured such that when it is connected to the shoulder straps, pulling on the shoulder straps does not compress the outer layer against the inner layer and therefore does not compress any objects within the first carrier pouch. In another aspect, the shoulder straps and inner layer together form loops configured to be worn over the wearer's shoulders, and the outer layer is configured to connect to the loops. In another aspect, the inner layer is directly connected to the shoulder straps and the outer layer is configured to be releasably connected to the loops.

In another aspect, the first child carrier portion is configured such that, when worn on a wearer, an opening is formed on either side of the first child carrier portion between the wearer's body, the first carrier pouch, the first waist support section, and the shoulder straps, through which the limbs of a child inserted in the first carrier pouch can extend.

In another aspect, the second child carrier portion is configured such that, when worn on a wearer, an opening is formed on either side of the second child carrier portion between the wearer's body, the second carrier pouch, the second waist support section, and the shoulder straps, through which the limbs of a child inserted in the second carrier pouch can extend.

In another aspect, the first child carrier portion is permanently secured to the shoulder straps and the second child carrier portion is configured to be releasably secured to the shoulder straps.

In another aspect, the first and second carrier pouches are configured so that no portion of the first or second carrier pouches comes between the torso of a child inserted into one of the carrier pouches and a wearer of the first and second child carrier portions.

In another aspect, the first and second waist support sections include structured waist bands configured to spread the weight of carried children over a large area of a wearer's hips. In another aspect, one or more of the structured waist bands are removable from the waist support sections. All waist support sections may be unstructured waist bands, permanently structured waist bands, or unstructured waist bands with removably attached structured waist bands, such that structured or unstructured waist bands may be used per the user's preference.

In another aspect, the shoulder straps curve in towards the center of a wearer on at least one side.

In another aspect, each carrier pouch is configured to hold a child of an intended size therein in a seated straddle position. In another aspect, the bottom of each carrier pouch is between eleven and fifteen inches wide. In another aspect, the bottom of each carrier pouch is twelve inches wide. In another aspect, one or more of the carrier pouches includes a mechanism for reducing or increasing its effective bottom width. In another aspect, the mechanism includes a scrunching assistor, a narrowing of the pouch from its bottom to a point above its bottom, or a seat extender or seat darts.

In another aspect, the shoulder straps and first carrier pouch together form loops configured to be worn over the wearer's shoulders and the shoulder straps present a barrier to a child falling out the side of the first carrier pouch.

In another aspect, the first and second carrier pouches are flexible enough that the rear end of a child inserted therein rests below the top level of the waist support sections.

In another aspect, the carrier includes one or more of an enclosure and a fastener connected to the second waist support section and configured to maintain the second carrier pouch in a collapsed position when disconnected from the shoulder straps.

In another aspect, the flexible material includes a single or double layer of fabric.

In another aspect, each of the first child carrier pouch and the second child carrier pouch is configured to extend behind the shoulder straps, such that a heavy weight in the opposite child carrier that presses the shoulder straps tightly against a wearer does not compress a child therein against the wearer.

In another aspect, the carrier includes a safety belt releasably secured across at least one of the carrier pouches to prevent a child from falling out of the at least one of the carrier pouches.

In a new child carrier method for carrying two children of different sizes simultaneously, the waist support sections of two carrier pouches are buckled together, a first shoulder strap is put over a wearer's shoulder, a first child of a first size is held in one of the two carrier pouches against the wearer's body, a second shoulder strap is put over the wearer's shoulder, one side of the other of the two carrier pouches is buckled to the first or second shoulder strap, a second child of a second size at least ten pounds different from the first size is held in the other of the two carrier pouches against the wearer's body, and the other side of the other of the two carrier pouches is buckled to the other of the first and second shoulder straps.

These and further and other objects and features of the invention are apparent in the disclosure, which includes the above and ongoing written specification, with the drawings.

BRIEF DESCRIPTION OF THE DRAWINGS

The above and other features and advantages of example embodiments will become more apparent by describing in detail example embodiments with reference to the attached drawings. The accompanying drawings are intended to depict example embodiments and should not be interpreted to limit the intended scope of the claims. The accompanying drawings are not to be considered as drawn to scale unless explicitly noted.

FIG. 17A-L depict a process for loading two children in an example embodiment of a carrier.

DETAILED DESCRIPTION OF THE PREFERRED EMBODIMENTS

Figure 1:
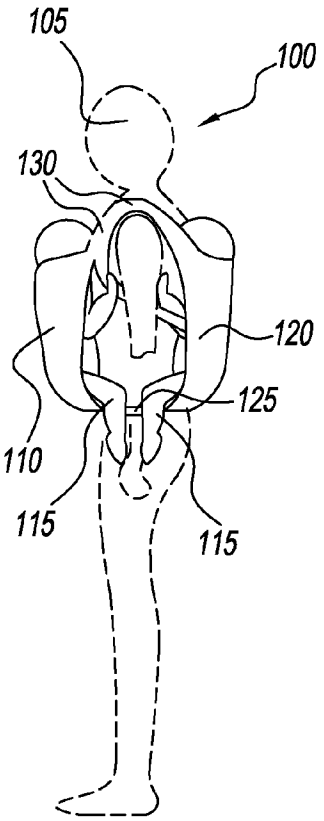
FIG. 1 depicts an example embodiment of a carrier.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the terms "and/or" and "or" include any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. The term "child" as used herein encompasses both infants and toddlers. An "adult wearer" as used herein refers to any user with the size/strength and mental capacity to safely carry children in a carrier. Thus, the adult wearer may be biologically but not legally an adult.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Most conventional carriers only allow for one infant or toddler at a time to be carried or supported by an adult. Even for conventional carriers that allow multiple children to be carried at the same time, the discomfort for both adult and children is so great as to prevent use for any extended period of time, particularly for older and heavier children. Accordingly, conventional multiple-child carriers are useful only for carrying smaller infants. Conventional multiple-child carriers also often do not allow for multiple children to be supported in a seated-straddle position facing the wearer.

The seated-straddle position provides support from knee "pit" to knee "pit", with the legs spread at a 45+ degree angle and knees slightly above the bottom at 90+ degree angles. The child's weight is distributed off the hip joints/genitals and onto the buttocks and thighs. Additionally, the child's spine is in a curved position, which is normal for the stage of development. This position mimics the way a mother would naturally hold her infant in her arms and how the infant's body would naturally be positioned. Other twin carriers may place infants in superficially similar positions, but have too-narrow crotch support that results in pressure on the hip bones or genitals or a spine that is too straight and forces the child to sit up straight, placing pressure on the spine. The pressures resultingly placed on the child pose a health risk to some children, for example boys and infants with hip dysplasia. Such health risks are avoided by the seated-straddle position.

Accordingly, the children within the carrier may experience uncomfortable and unsafe stress in their leg ligaments due to being held in an outward-facing position. Children facing away from the carrier may also become over-stimulated, without the ability to turn away from the stimulus. Front facing carriers do not provide proper leg support, which can make a child's pelvis tilt backward, hyperextending the child's spine and placing the child in the dangerous concave "hollow back" position. Facing out is a nonphysiological position that places pressure on the inner thighs of the baby and the base of the spine. The infant then absorbs the pressure produced with each step that the mother takes on the child's hyper-extended spine. Positional asphyxia is also possible with front-facing carriers when babies have no neck control and their chin falls toward their chests. Outward-facing children also result in an awkward load for the wearer and often cause the wearer's back to arch, stressing the wearer's lower back, shoulders and neck.

Conventional carriers can also be difficult to take on and off and can make the loading and unloading of children difficult. They have many different parts and require many steps to properly load and unload. None of the conventional multi-child carriers allow for carrying two children having substantially different sizes/weight at the same time—for example an infant and a toddler. Embodiments of the present invention allow for this due to independently adjustable waist sections and shoulder straps, carrier pouches that position children facing inwards and direct their weight to the wearer's hips, and the fact that the carrier pouches are attached only by adjustable straps, allowing them to be fitted to adapt to changing weight distributions. Configuring one carrier pouch for wearing in the front of a wearer and another carrier pouch for wearing in back of the wearer also helps, as a wearer can naturally carry more weight in back than in front, which causes uneven front-back weight distributions to feel balanced, and as some forces offset each other.

An infant is generally considered a newborn to 12-month-old baby, whereas a toddler is generally considered to be any child 1-3 years of age. A newborn weighs 7-8 pounds on average, with a maximum of around 10 pounds, whereas a one-year-old weighs 22-23 pounds on average and may weigh as much as 30 pounds and a three-year-old weighs on average 30 pounds, with a normal range of 25-40 pounds. Conventional multi-child carriers do not allow for carrying a child of around 10 pounds and a child of 20-30 pounds at the same time. Carrying such a large overall load and such different loads requires isolation of one carrying pouch from the other, careful distribution of weight, correct positioning of the children for safe and efficient postures, and flexibility of support and safety features.

Example embodiments described herein disclose an ergonomic, soft-structure, frameless backpack-style carrier allowing for the weight of two children to be distributed around the hips of an adult wearer, permitting the adult wearer to easily put on, take off and/or load and unload children from the carrier and to comfortably and safely carry the children for extended periods of time. Within example embodiments, any known method may be used to insert or dispose a baby into a back carrier pouch. For example, a wearer may place the back pouch on the side of his or her hip to insert the child, and then rotate the belt and carrier after the child is inserted (or vice versa to remove the child), sling the baby around the back and into the pouch (as illustrated in FIG. 17), or for older children, let the child get onto the back of the wearer and then buckle the pouch around them. The carrier can also be laid on a couch or other piece of furniture, the child can be seated within the carrier in the position for carrying, and then the wearer can buckle the waist and put on the shoulder straps while the carrier is still supported by the furniture. That method may be helpful for nervous individuals with small babies.

Furthermore, example embodiments described herein allow for converting, modifying or changing from a carrier supporting multiple children to a carrier allowing for the support of a single child without the need for adding any additional parts. One carrier pouch can simply be removed and the remaining carrier pouch has the appearance of a normal single-child carrier. The single carrier may be worn on the back or the front, as shown for example in FIG. 13.

FIG. 1 depicts an example embodiment of a baby carrier 100. Carrier 100 may include a second carrier/pouch 110, a first carrier/pouch 120, waist strap 125 and shoulder straps 130. More specifically, the carrier 100 may be utilized by a wearer 105 to carry at least one child in the second carrier pouch 110 and another child in the first carrier pouch 120. The second carrier pouch 110 may be disposed in front of the adult wearer 105, while the first carrier pouch 120 may be disposed behind the adult wearer 105.

The second carrier pouch 110 and the first carrier pouch 120 may allow for children to face inwards towards the adult wearer 105 in a seated-straddle position, sitting on their bottoms and straddling the waist of the wearer. Existing twin carriers do not permit carrying two children in a straddle position (legs spread and elevated 90+ degrees at the hip). To allow for a straddle position, the bottom of the carrier pouch 115, which supports the child's bottom and legs, may be wide enough to go from one knee "pit" of a child to the next knee "pit" when the child's legs are straddling the waist of the adult wearer. That fabric width allows the child to effortlessly sit in a straddled position with the legs at a 90 degree angle from the body, as can be better seen for example in FIG. 17. This straddled position allows for the child's weight to be distributed evenly around the waist of the wearer because the child's legs follow the curve of the wearer's body and are partially supported thereby. For the child, the straddled position places the seated pressure on his or her bottom and supports the child's legs. If the fabric is not wide enough, the legs hang down. When the legs hang down, the weight of the child weighs heavily on the groin and ligaments instead of the bottom. This can lead to chafing, hip dysplasia, and other ailments. Also, this position puts excessive pressure on the shoulders and neck of the wearer.

A 12-inch width generally accommodates children from three months to about eighteen months of age and 25-30 pounds for true knee-pit to knee-pit support and 90+ degree hip bend, with smaller children scrunching or folding the material to the most comfortable and supportive width. For larger children, a 12-inch width may not be sufficient to achieve a full 90+ degree hip bend (resulting in an 80-85 degree bend), however larger children are stronger and further along in development, and also more able to convey discomfort, making them less at risk for hip dysplasia and other possible health consequences of imperfect posture. However, for full support, a 15-inch width accommodates children up to approximately three years of age and 40-45 pounds while maintaining a 90+ degree hip-bend, although it is less fitting for a smaller baby.

Prior to around 12 weeks of age, infants need to be carried with their legs tucked to their stomachs with ankles crossed. Around twelve weeks of age, an infant's joints begin to loosen and can straddle about 90 degrees (a 45-degree spread for each leg). The degree of leg-spread required for straddling depends on the size of the adult. Babies are very limber and quickly become capable of very wide leg spreads.

Since the carrier pouch is flexible in embodiments, and may be for example a cotton/poly fabric, it can be scrunched inward to better fit smaller babies' knee-to-knee spreads. In some embodiments, a drawstring or similar and/or a section of elastic material at the bottom of the carrier pouches may make it easy to scrunch the sides together to reduce the width. Bottom carrier width can also be adjusted in various embodiments by rolling/wrapping the carrier pouch around the waistband (which also adjusts the height of the pouch). The width of a carrier pouch may vary at the bottom and at various points along its height, and the width of the effective bottom of the carrier pouch can be varied by rolling the bottom of the pouch around the waistband. For example, if the carrier pouch is wider at the very bottom than at a point a few inches higher up, the carrier pouch fabric may be wrapped around the waistband until the effective bottom of the carrier pouch is that point a few inches higher up, making the effective bottom slightly narrower than before. For example, the very bottom of the carrier may be 12 inches wide in an embodiment, but move up the back of the carrier a few inches and it may curve in slightly to 9 inches, which is helpful for when the waist is rolled for smaller babies who have a smaller knee-to-knee measurement. Alternatively, the material may be scrunched slightly for smaller babies or the fabric rolls may be rolled over under the knees.

In some embodiments, some points along the length of the carrier pouch may be wider than at the very bottom, allowing the width to be increased for larger children. In embodiments, the carrier also does not have a structured waist band, so the waist band remains flexible to mold to the shape/size of the child carried, thus avoiding the need for an infant insert to provide extra fabric to fill in gaps for small babies, as is required for carriers with structured waist bands, similar to those used for hiking backpacks. A structured waist band cannot be rolled up to reduce the size of an attached carrier pouch. Small babies must be worn higher on the wearer's hips, the rule of thumb is "close enough to kiss." Since the baby is short and the baby's head needs to be high on the wearer's chest (close enough for the wearer to bend the wearer's head down and kiss the top of the baby's head), the structured waist band has to be worn higher than the hip bones. When it is worn higher, the back of the carrier is longer than necessary and there are gaps in the fabric. For the baby to be safe and supported, the fabric should be snug against the baby, and therefore inserts are necessary. With an unstructured waist band, the excess fabric can be rolled so there are no gaps and the fabric molds to the shape of the baby. A flexible waistband also curves down slightly where a loaded carrier pouch connects to the waist band, due to the weight of the child therein, which helps the carrier pouch to mold to the shape of the child. Structured waistbands are too rigid to deform in this fashion.

Also, the fabric above a structured waist band (the part that the baby sits in) cannot be easily scrunched to reduce its width for smaller babies, because it is fixed/stitched in its width to the rigid structured waist band. These carriers then have to have seat extenders (extra fabric that unfolds to button to the waist to widen the width). With an unstructured waist band, the carrier pouch bottom can be easily scrunched or have a drawstring to reduce the width of the fabric. Other embodiments of the present invention do use structured waistbands, for one or both carrier pouches, to provide better support for larger children.

Footstraps can also be used to provide additional support for larger children for whom the width of the bottom of the carrier pouches may be insufficient to provide full (knee-pit to knee-pit) support. Footstraps are known in the art and are another method of providing leg support and raising the legs to a 90-degree angle with the hips for children old enough to control their legs and follow instructions, approximately two-plus years old.

In embodiments, the bottoms of the carrier pouches are wide enough to extend from knee-pit to knee-pit of a child of a desired size inserted in each carrier pouch. Thus, the width and design of the carrier pouch bottoms may vary depending on the size of child the carrier is intended to carry. For example, there may be an infant carrier with smaller dimensions and reduced weight and bulk, with carrier pouch bottoms of less than twelve inches in width (for example eleven inches). Another embodiment may be configured to carry a large child in a back carrier pouch and an infant in a front carrier pouch, and therefore the back carrier pouch may have for example a fifteen inch wide bottom, while the front carrier pouch has an eleven or twelve inch wide carrier pouch bottom. Another embodiment may be configured to carry two larger children and each carrier pouch bottom may be fifteen inches wide. In another embodiment, one or both carrier pouches may be configured for use with a wide range of child sizes, and may have a bottom width of between eleven and fifteen inches, and may additionally have one or more mechanisms for varying the effective bottom width. Mechanisms for varying bottom width include scrunching assistors such as drawstrings and elastic fabric sections, narrowing or widening of the pouch along its length, combined with the ability to roll up the pouch around a waistband or other part, foot straps, a foldable section of width, some other adjustable width, or some type of seat extender or seat darts to make the bottom extend further down and away from the wearer so that heavier children will sit further down and back, forcing their legs into a larger angle to the hip even if the carrier pouch fabric does not span from knee-pit to knee-pit.

In the embodiment shown in FIG. 1, soft-structure first and second carrier pouches create "bucket" or "cupping" shaped curved pouches for each child to sit in, which helps provide adequate support for the child and to direct the child's weight to the wearer's hips. To form the "cupping shape" the wearer may put the carrier on like an apron (hanging down), then hold the child against their body, and finally bring the carrier up against the back of the child and secure it, which makes the soft carrier pouch fabric into the cup shape for the child to sit in. This fabric cup comfortably holds the child in the correct position against the wearer without the support of the wearer's arms. The width of the bottom of the pouches allow for the children to effortlessly sit in a seated position straddling the wearer. A straddled position can only be done by facing the wearer, hence there is not an option to face outward (human anatomy does not permit for legs to bend substantially backwards from the hip). Since this carrier is designed to effortlessly carry two children, in embodiments it distributes weight optimally to maximize comfort for the wearer, and thus allows each child to straddle the wearer. In embodiments, the carrier uses gymnastic rubber in the shoulder straps, which absorbs movement and distributes weight all along the shoulder straps and supports 50-60 lbs of compression per shoulder strap, reducing or eliminating pinching and digging of the shoulder straps into the wearer and allowing longer, more comfortable bearing of heavy shoulder loads. A sternum/chest strap may also be used to keep the carrier in position on the wearer's shoulders and the carrier pouches in direct front/back opposition. This is discussed with more detail in reference to FIG. 18. When the carrier remains in place with little movement, the movements of the children affect the wearer less as balance is not disturbed, and the impact on the wearer's joints is minimized, even when traversing difficult terrain such as stairs, uneven surfaces, hiking trails, narrow pathways, etc. Such terrain can be very difficult to safely traverse when wearing traditional carriers, which allow shifting children to throw off a wearer's balance, and do not hold children tightly to the wearer's body, creating large moments of inertia and torques on the wearer's body.

Figure 5:
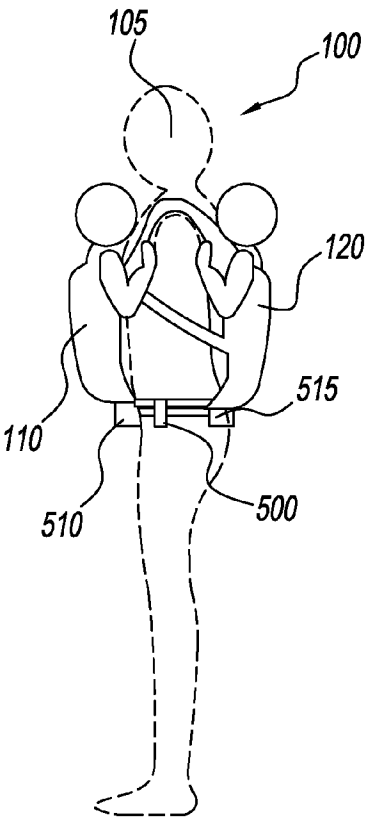
FIG. 5 depicts an example embodiment of a carrier in which the carrier pouches have interlocking, structured waist bands.

The carrier pouches may be a single layer or double or multiple parallel layers of fabric extending from a lower border substantially adjacent to the wearer's body to a top border that is disposed some distance away from the wearer's body, allowing an inserted child to rest on and be supported by the bottom of the fabric and the wearer's body and leaving room for the child's body and head towards the top of the fabric. This convex carrier pouch design, with a pouch that curves inward and down from the top to the waistband, directs most of the child's weight towards the wearer's body, pressing the child's body against the wearer and bearing the child's weight on the waist strap around the wearer's hips. In embodiments, padding may be inserted between layers of fabric for comfort. Padding increases bulk, requiring more storage space when not in use, which is of greater concern with multiple-child carriers that are inherently bulkier than a single carrier, but may still be desirable depending on the intended use of the carrier and the wearer's preferences and characteristics. The child's legs may ball up in the bottom of the pouch, as shown in FIG. 5, when the child is a newborn without the ability to sit in a straddle position. Note that although FIG. 5 shows a balled up child in the rear carrier, it is generally preferable to carry a balled-up infant in a front carrier for safety reasons (e.g. ease of monitoring the child and maintaining the child's position inside the carrier). For larger children, the legs may extend out the sides of the piece of fabric, but the base of the second carrier pouch 110 and the first carrier pouch 120 may be wide enough (knee-pit to knee-pit) to support the larger children in a straddle position such that the carried child's weight is still substantially supported by the child's posterior (and ultimately by the wearer's hips). Therefore, the children may be seated in a straddled or, for young infants, balled position facing towards the wearer 105, and may be substantially supported by their own posterior and/or back. Thus, additional stress is not placed on the legs of the carried children while placed in either the second carrier pouch 110 or the first carrier pouch 120.

Because all the children's weight settles on the bottom of the carrier where the carrier meets the wearer's body, due to the soft structure and inward curvature of the carrier, and because the straddle/ball position allows a large part of the child's body to press against the wearer, the load is distributed primarily around the wearer's hips and, through shoulder straps, also in part to the user's shoulders. The shoulder straps also absorb outward forces and lateral forces, for example from shifting of the children. Because the load is directed primarily against the user's hips and, when carrying two children, in opposing directions (i.e. from the front and from the rear), balanced forces are applied to the parts of the body best suited for handling them, dramatically increasing comfort and extending use time. Loads applied primarily to a user's shoulders, in contrast, particularly unbalanced loads, can lead to rapid discomfort and even injury.

The second carrier pouch 110 may allow for a child to be seated upright, facing the adult wearer 105 in a straddled position while disposed in the second carrier pouch 110. The first carrier pouch 120 may allow for a child to be seated upright, facing the wearer 105 in a straddled position while disposed in the first carrier pouch 120.

Waist strap 125 may be a length-adjustable belt to ensure a proper fit around the wearer's waist. In another example embodiment, waist strap 125 may be made of webbing strong enough to support any practical loads experienced during use, for example 200-1,000 lbs, and in one embodiment 500 lbs, and which is inelastic under that weight limit. A lack of give in the strap and carrier pouch materials ensures that the carrier firmly holds children in the proper position. Nevertheless, in an alternative embodiment elastic materials may be used. Elastic material may be useful for hoods, where elasticity allows the hoods to more easily accommodate the shifting of a child's head during sleep.

Figure 2:
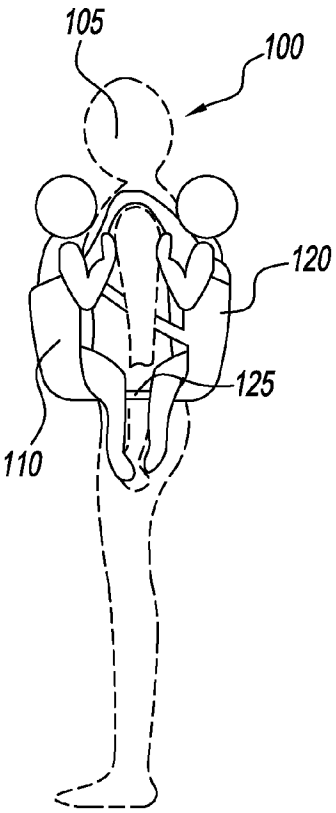
FIG. 2 depicts the example embodiment of the carrier of FIG. 1 in which the waistband has been folded to reduce the size of the carrier pouches.
Figure 15:
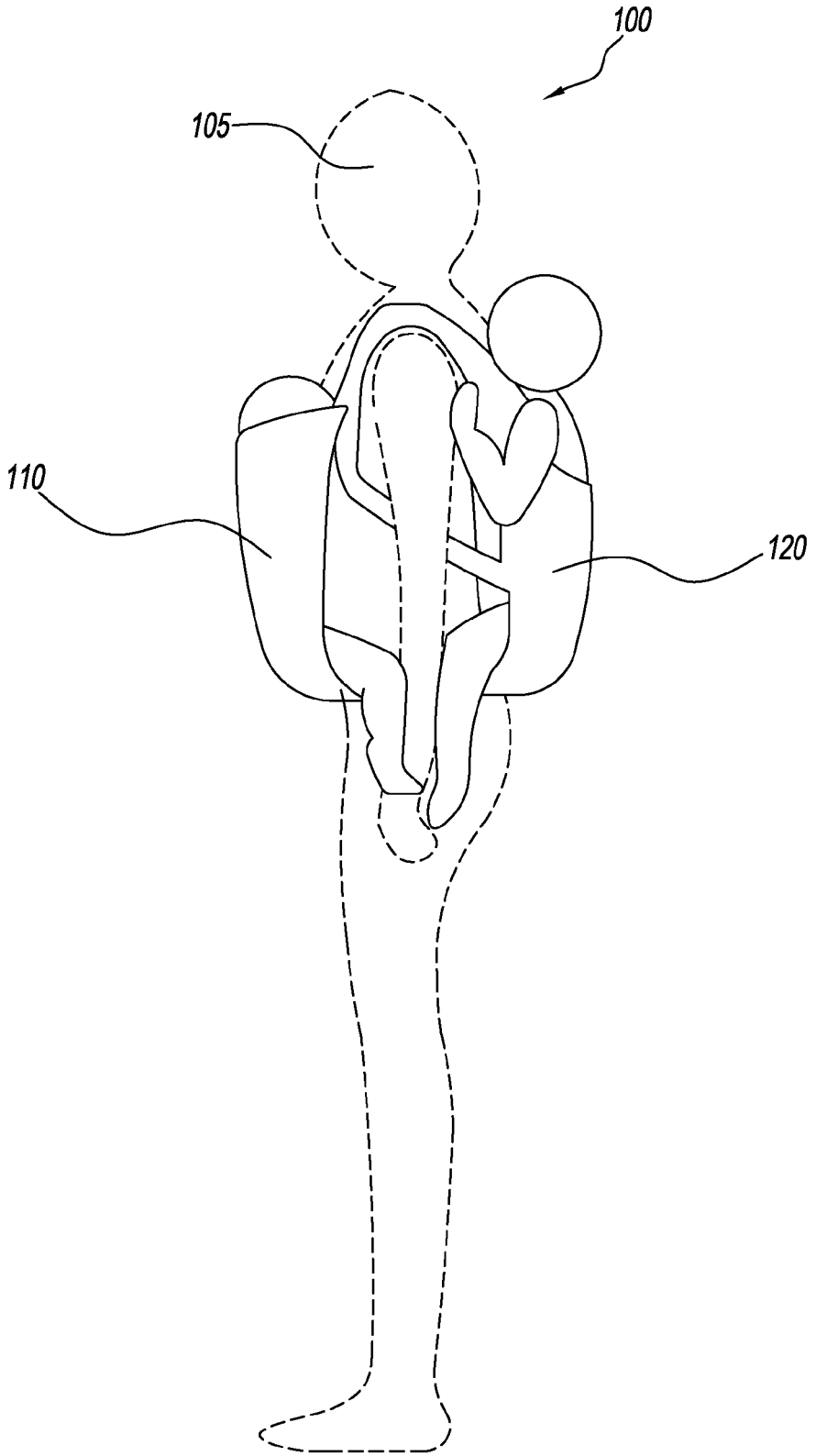
FIG. 15 depicts an example embodiment of a carrier holding a larger child in the first carrier pouch and a smaller child in the second carrier pouch.

Waist strap 125 may be rolled/folded up to adjust the size of the second carrier pouch 110 and/or the first carrier pouch 120 as shown for example in FIGS. 2, 15 and 20. In an embodiment with a buckle or other fastener on each side of the wearer (and therefore independent waist strap portions corresponding to each carrier pouch), the waist strap 125 portion connected to each carrier may be independently rolled up with the bottom of the pouch to adjust the size of the corresponding carrier pouch prior to fastening the two waist strap 125 portions together as described in detail below with regard to FIG. 3. Once the waist strap has been fastened, or in an embodiment with a single buckle or other fastener, the entire waist strap may be rolled up to adjust the size of both carriers simultaneously. Such simultaneous adjustment is still quite useful for, e.g., twins. If a toddler or sleeping infant will be placed in one pouch, that pouch may be left fully extended (unrolled), but if there is a small infant who will need to see out, the infant's pouch may be rolled to adjust only that one pouch (the fabric pouch shortens upon rolling). The rolling, as noted above, may be independent of the other carrier pouch. This makes for two different pouch fits for two different sized children. For similarly sized children, both carrier pouches may be rolled to the same length. Additionally, carrier pouch height may be reduced by folding down the top of the carrier pouch. In embodiments, the top of the carrier pouch may extend above where it connects to the shoulder straps, or may be curved so that it is higher in the back than on the sides where it attaches, allowing some portion to be easily folded down for adjustment.

Figure 12:
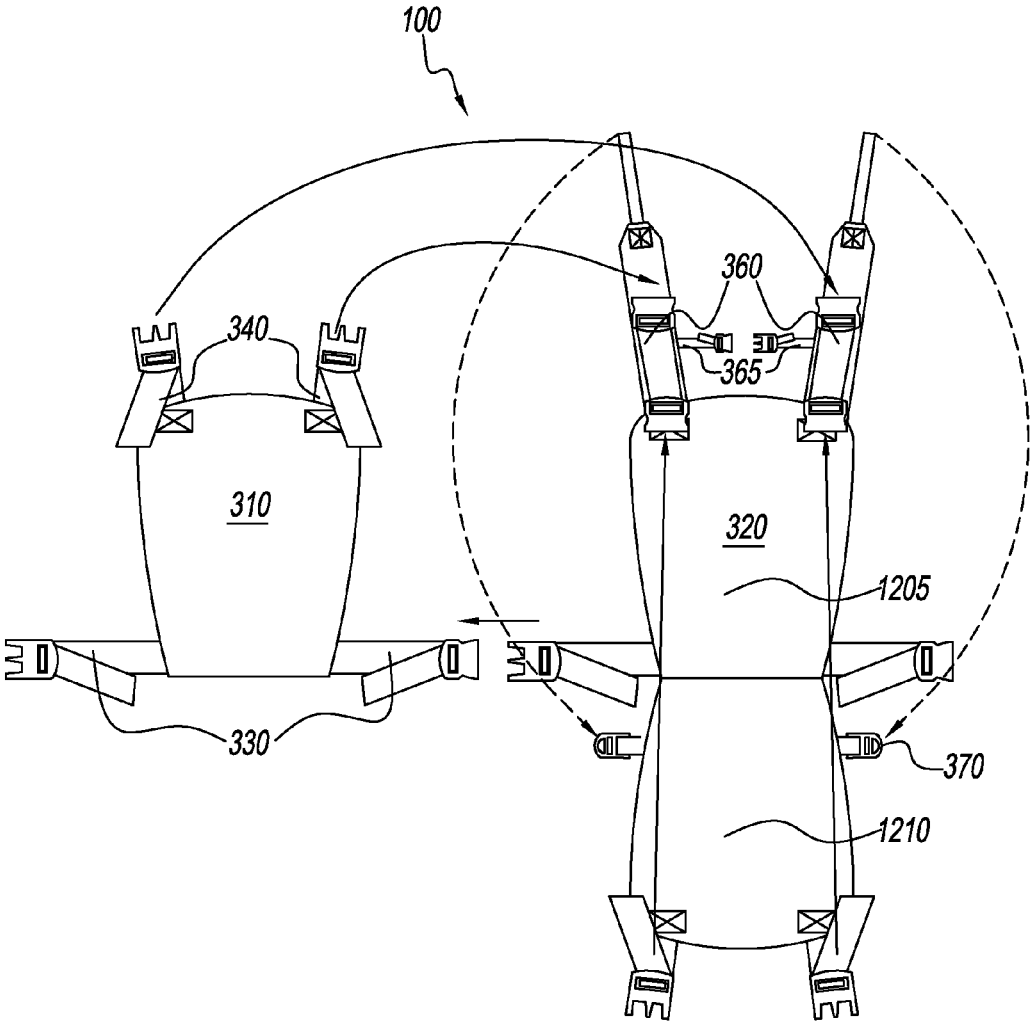
FIG. 12 is a diagram depicting the front and back of the carrier and connections between first and second carrier pouches in an example embodiment.

Shoulder straps 130 may be adjustable straps to secure and/or adjust the shape of the second carrier pouch 110 and/or the first carrier pouch 120. Adjusting the shoulder strap length assures a secure and comfortable fit on the wearer's shoulders, and also snugs or loosens the carrier pouch, which can help to accommodate variously sized children. In some embodiments, the second carrier pouch 110 and the first carrier pouch 120 may each attach separately to independent shoulder straps 130 (as shown in FIG. 12). The carrier may be configured such that shoulder straps 130 are first disposed on an adult wearer 105, and then either the second carrier pouch 110 or the first carrier pouch 120 may be buckled or clipped to the shoulder straps 130. In other words, the shoulder straps 130 may be initially disposed on the adult 105, a child may be disposed against the adult's body, and then the adult 105 carrying the child may raise the front or back carrier pouch and clip or otherwise secure it to the shoulder straps 130 to support the carried child. Accordingly, the first or second carrier pouch 110, 120 may already be clipped or buckled to the shoulder straps 130 with a supported child, then another child may be disposed or inserted into the other carrier pouch, and the other carrier pouch may then be buckled to the shoulder straps 130. For added safety, one side of the front or back carrier pouch may be secured to the shoulder straps 130, then a child can be inserted into the front or back carrier pouch, and then the other side may be secured to the shoulder straps 130, making it less likely that the child will slip during this process. Carrier pouches that attach to and detach from the shoulder straps therefore allow for a substantially easier method for disposing a plurality of children of varying sizes into a carrier then conventional carriers.

In some embodiments, weight in one carrier pouch will pull on the other carrier pouch. As a result, a heavy child in one carrier pouch could pull the other carrier pouch tightly against the wearer, potentially causing discomfort or even an unsafe condition (excessive compression) for a smaller child in the other carrier pouch. For a carrier designed to carry two children differing significantly in size, it is important for at least one of the carrier pouches to remain unaffected by weight in the other carrier pouch, to the extent that a heavy weight in the other carrier pouch will not cause that pouch to be drawn uncomfortably or dangerously close to the body of the wearer. In the embodiments shown in FIGS. 3, 14 and 21, for example, the second carrier pouch 310 is unaffected by weight in the first carrier pouch 320, because the second carrier pouch 310 is connected to the shoulder straps and first carrier pouch 320 only by clips 395 and adjustable straps 340. Straps 340 provide some space between the carrier pouch 310 and shoulder straps 130, so no matter how heavy a child in carrier pouch 320 is and how hard the child's weight pulls the shoulder straps against the wearer, the second carrier 310 will never get closer to the wearer than the length of the adjustable straps 340 and clips 395.

In contrast, in those embodiments first carrier pouch 320 is affected by weight in second carrier pouch 310. Carrier pouch 320 is connected directly and essentially parallel to shoulder straps 130, in fact the pouch 320 actually completes the loops of material that go around a wearer's shoulders. So when the shoulder straps 130 are pulled tight against the wearer, the first carrier pouch 320 will be as well. Thus, a heavy weight in the second carrier pouch 310 could create an uncomfortable or unsafe condition for a smaller child in the first carrier pouch 320. Therefore, in such embodiments the larger child should generally be seated in the first carrier pouch 320 when multiple children are being carried. The same is true of any embodiment where the first carrier pouch 320 is affected as described above by a heavy weight in the second carrier pouch 310, but the second carrier pouch 310 is not so affected by a heavy weight in the first carrier pouch 320.

Such problems may be avoided in various embodiments simply by ensuring that no matter how tight the shoulder straps are pressed against the wearer, the carrier pouches (or at least the portions of the carrier pouches behind the child that could potentially compress the child against the wearer) never get dangerously or uncomfortably close to the wearer's body. For example, there may simply be significantly more material in first carrier pouch 320 between the two shoulder straps, making the pouch much looser. Then, even with the sides of the carrier pouch 320 compressed tightly against the user, the middle of the pouch where the child's body sits would be loose and not constricting. The downside of that simple approach, in the absence of workarounds (e.g. simple mechanisms for pinning the material to make it tighter when excess material is not needed) is excessive looseness of the carrier in other circumstances, as it is generally desirable in everyday use for carried children to rest lightly but securely against the wearer's body. Therefore, various other approaches may be taken in various embodiments. For example, the rear part of the carrier pouch that presses on the child's back to secure the child against the wearer's body may be separated from the loop of material that goes around the wearer's shoulders and may be attached to the shoulder straps by an adjustable strap and clip. That is the approach taken for the second carrier pouch 310 in FIGS. 3, 14 and 21 and the approach taken for the first carrier pouch 320 in FIG. 12 and keeps the rear of the carrier pouch a safe distance from the wearer's body regardless of the weight in the other carrier pouch.

In embodiments where both carrier pouches are unaffected to the extent described above by a heavy weight in the opposite carrier pouch, the order of disposing children into either the second carrier pouch 110 or the first carrier pouch 120 may not matter. In other words, an infant may be placed in either the second carrier pouch 110 or the first carrier pouch 120 while a larger child may be placed in the other carrier, because the weight of one child in either the second carrier pouch 110 or the first carrier pouch 120 does not pull on or affect the size or shape of the other carrier. Accordingly, the sizes and weights of the children in the second carrier pouch 110 and the first carrier pouch 120 may be substantially different. This is helpful for parents of multiple non-twin children, where the children are typically at least one to two years apart in age.

Figure 3:
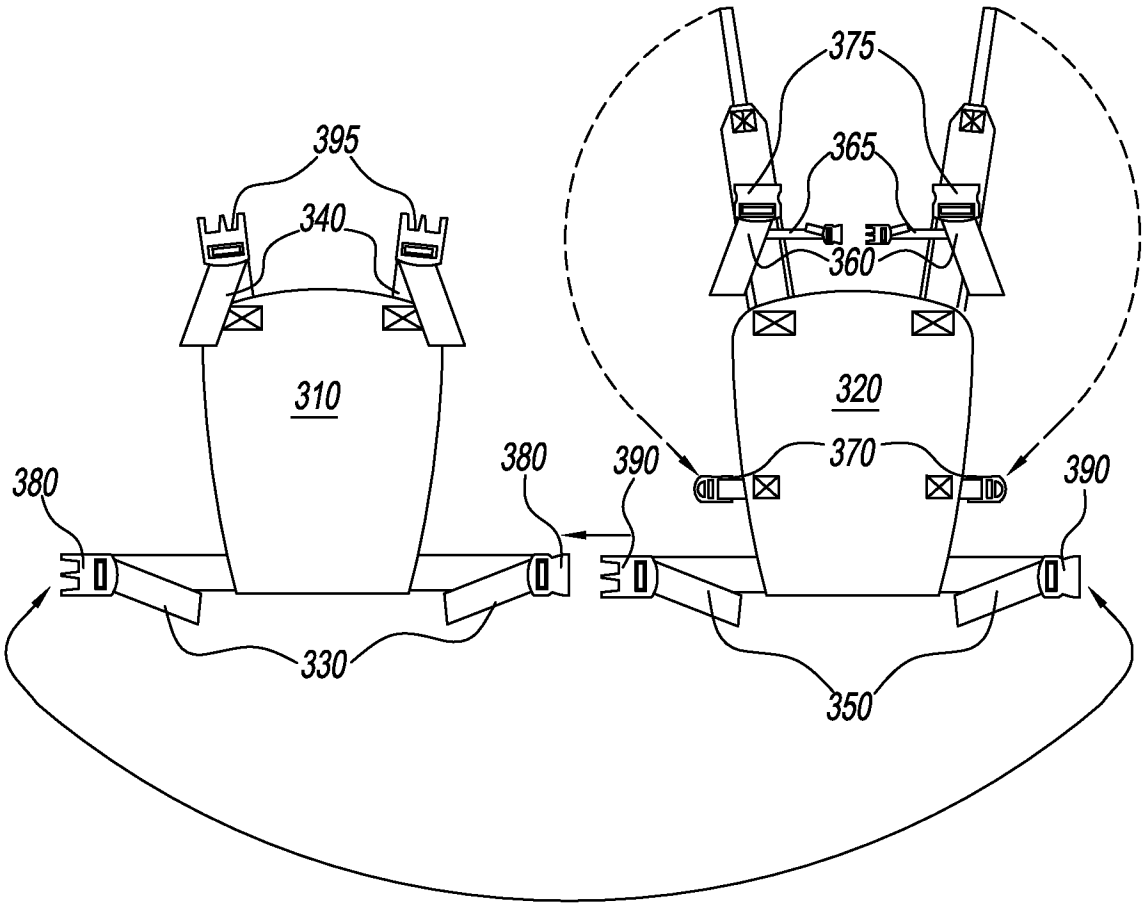
FIG. 3 is a diagram depicting the front and back of the carrier and connections between first and second carrier pouches in an example embodiment.
Figure 18:
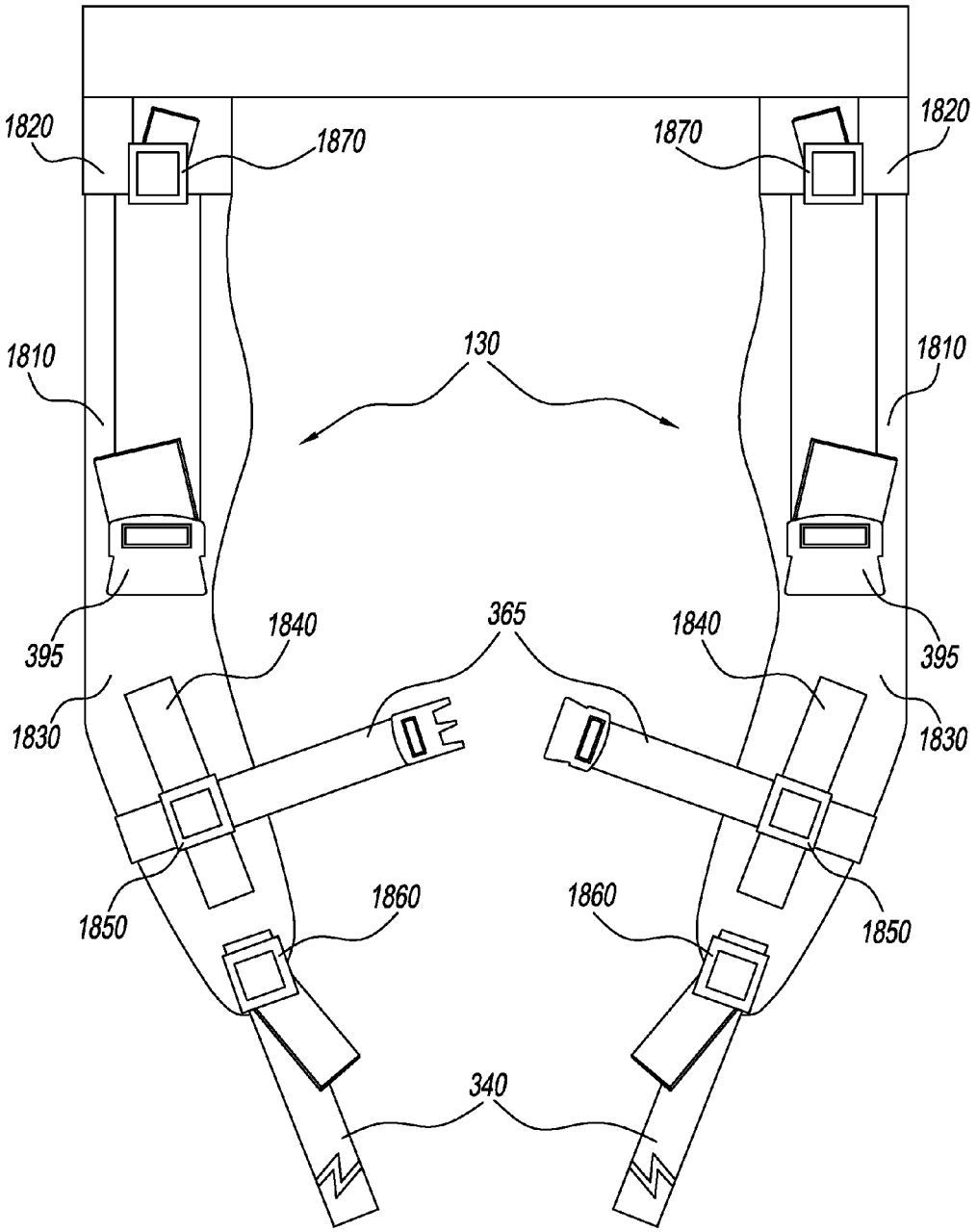
FIG. 18 depicts carrier shoulder and chest straps, in an example embodiment.

In even further example embodiments, a chest strap may be used to secure the shoulder straps 130 to the wearer 105 and/or each other, and prevent or limit the shoulder straps 130 from slipping, as shown in FIGS. 3, 12, and 18. The less wiggle room the carrier has, the more the carried weight moves in-line with the wearer, making it easier for the wearer to bear heavier loads while moving.

FIG. 2 depicts an example embodiment of carrier 100. In FIG. 2, the front and back carrier pouches 110, 120 have separate waistband portions that buckle or otherwise can be secured together and waist strap 125, formed by securing together the individual waistband portions, has been rolled up or folded to create a shorter second carrier pouch 110 and a shorter first carrier pouch 120. Although the sizes of the pouches in FIG. 2 are substantially the same, by rolling or folding only the waist strap 125 portion for the second carrier pouch 110 or the first carrier pouch 120, the sizes of the second carrier pouch 110 and the first carrier pouch 120 may vary as shown in FIG. 15. Of course, if the individual waist portions are to be rolled separately, this must be done prior to buckling/securing the two portions together.

FIG. 3 depicts an example embodiment of a carrier 300 including first and second carrier pouches 320, 310 having independent waistband portions 350, 330. In this embodiment, the shoulder straps 360 are directly connected to the first primary carrier pouch 320 and the second carrier pouch 310 buckles/attaches to the first primary carrier pouch at the shoulders and waist. The first primary carrier pouch 320 has standard clip ends 390 at the end of its waistband portion 350, which can clip to each other around the wearer's waist for use of the first primary carrier by itself, or may clip to the corresponding ends 380 of the waistband portion 330 of the second carrier pouch 310 to form a double carrier. The waistband portions 350, 330 may be secured to their respective clip ends 380, 390 by standard adjustable means and the clip ends 380, 390 may be slid along the length of the waistband portions to adjust their length for a proper fit and to provide appropriate support for a child. By adjusting the relative lengths of the waistband portions while keeping the same overall waistband length, the tightness of the individual carrier pouches can be adjusted while the overall fit for the wearer remains substantially the same.

The second carrier pouch 310 may also have adjustable top straps 340 that are attached to clip ends 395 or other fasteners for connection to corresponding clips/fasteners 375 on shoulder straps 360. The adjustable top straps 340 may be tightened, pulled or released to adjust the fit and size of the second carrier pouch 310. Similarly, the first carrier pouch 320 may have clip ends 375 attached directly to shoulder straps 360 or attached to the shoulder straps by adjustable straps for further adjustment of the second carrier pouch. Furthermore, the first carrier pouch 320 may have adjustment clips 370 where the shoulder straps are secured to allow for adjustment of shoulder strap fit to accommodate wearers and children of various sizes. Lengthening the shoulder straps allows the pouch to be pulled away from the body of the user when a larger child is inserted, increasing the pouch capacity and allowing larger children to be carried.

As noted, the waistband portion 330 of the second carrier pouch 310 may clip or be buckled into the waistband portion 350 of the first carrier pouch 320, and the top straps 340 of the second carrier pouch 310 may be buckled or clipped into the clip ends 375 on the shoulder straps 360 of the first carrier pouch 320. Accordingly, the weight or a load of children or items within the second carrier pouch 310 and the first carrier pouch 320 may be displaced via the waistband supports and the shoulder straps and optionally a chest support 365. The chest support 365 may be, for example, a strap extending between the shoulder straps 360 in the front with a clip in the middle. Clipping the two sides of the strap together links the shoulder straps and prevents them from sliding outwards away from one another, where they could slip from a wearer's shoulders.

In some embodiments, various fasteners (e.g. hook-and-loop fasteners, snaps, D-rings, other clip types, etc.) are used instead of or in combination with clips 375, 380, 390 and/or 395. The first carrier pouch may easily be worn on the front of a user as desired. In embodiments, the first carrier pouch could also be worn on the front when both pouches are in use. However, it is then difficult or impossible in this embodiment to take the second carrier pouch on or off without assistance, as the second carrier pouch must be secured to the shoulder straps of the first carrier pouch in order to function, and the securing clips are located behind the wearer's back. Also, in embodiments where the shoulder straps are integrated with the first carrier pouch (e.g. FIGS. 1-10), the way the shoulder straps attach under the wearer's arms presents an additional barrier across the side openings of the first carrier pouch and provides an additional attachment point where the first carrier can be tightened to keep the first carrier pouch snug around the child's waist so that the child cannot fall out. The front carrier in such embodiment may lack that added support, not being integrated with the shoulder straps. Wearing the second carrier pouch on the back may therefore be less safe in such embodiments.

Figure 22:
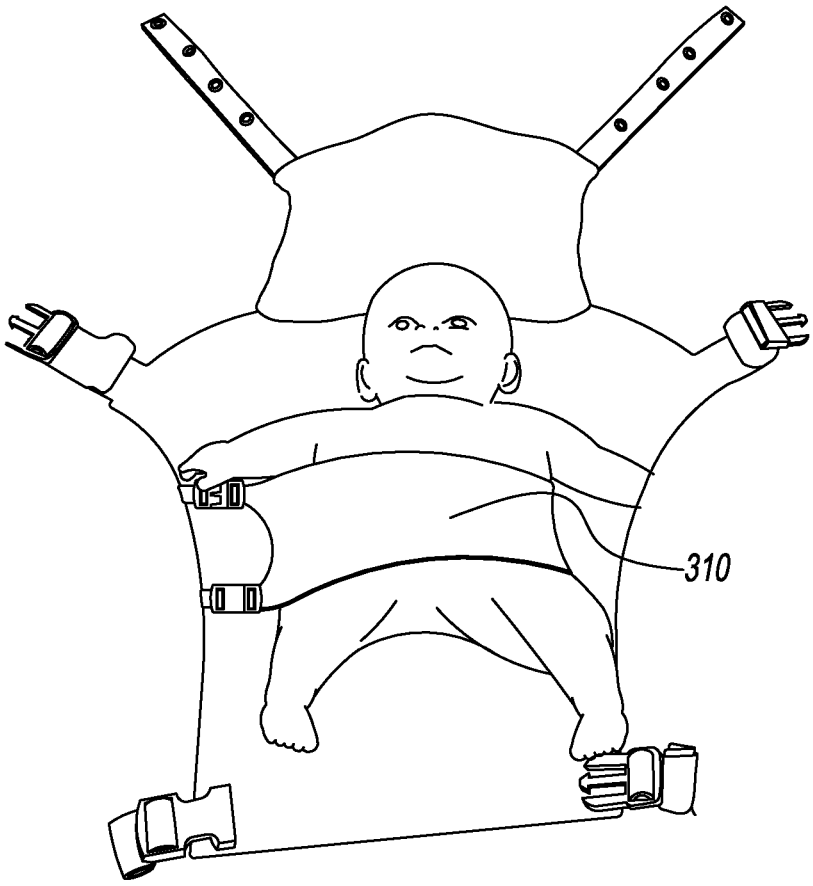
FIG. 22 depicts an embodiment of a carrier having a safety belt on the second carrier pouch.

However, in other embodiments the second carrier pouch may have a seat belt or an additional strap that can be connected to an attachment point on the shoulder straps or first carrier pouch, or from one side of the second carrier pouch to the other, to provide similar benefits. Such a belt or safety strap would also provide additional safety when the second carrier pouch is worn on the front, in the case of a very small child and a distracted wearer or a wearer traveling through unsafe terrain or in an unsafe manner, helping to avoid any scenario in which a child could slip out the side of the carrier. FIG. 22 depicts an embodiment of a safety belt 2200 on the second carrier pouch 310.

In some embodiments, the shoulder straps may be independent of either carrier pouch, and each carrier pouch may be buckled to the independent shoulder straps when in use to secure them. FIG. 12, for example, illustrates an embodiment where each carrier pouch is at least partially independent of the shoulder straps.

Figure 4:
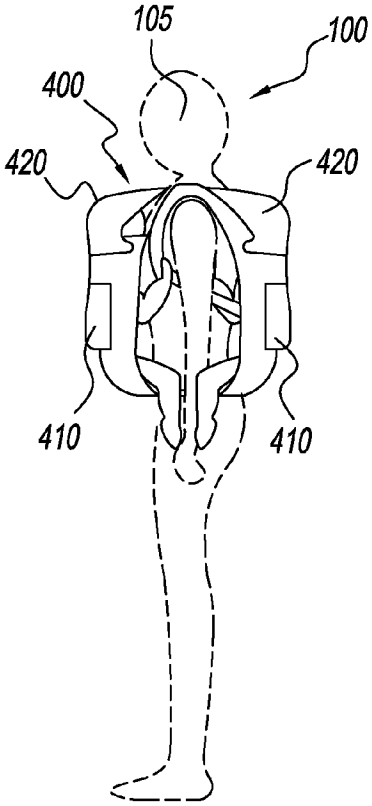
FIG. 4 depicts an example embodiment of a carrier in which the carrier pouches have pockets and hoods.

FIG. 4 depicts an example embodiment of a carrier 400. Carrier 400 may include a plurality of pockets 410 and head supports 420 for the second carrier pouch 110 and/or the first carrier pouch 120. Pockets 410 may allow the adult wearer 105 to hold such things as diapers, wipes, cell phone, keys and/or a wallet. However, in even further example embodiments the carrier 400 may include a cell phone holder, a mirror, a key ring, toy attachments, etc.

Head supports 420 may be disposed or positioned to support the head of a child while the child is within the carrier. More specifically, head supports 420 may support the head of a sleeping child. These head supports 420 are attached near the top of the carrier pouches 110, 120 and to the shoulder straps or opposite carrier pouch, using snaps, hook-and-loop fasteners, or another fastener. Head supports 420 when in an upright position prevent a child's head from rolling backwards when the child is sleeping and the wearer is moving.

Figure 11:
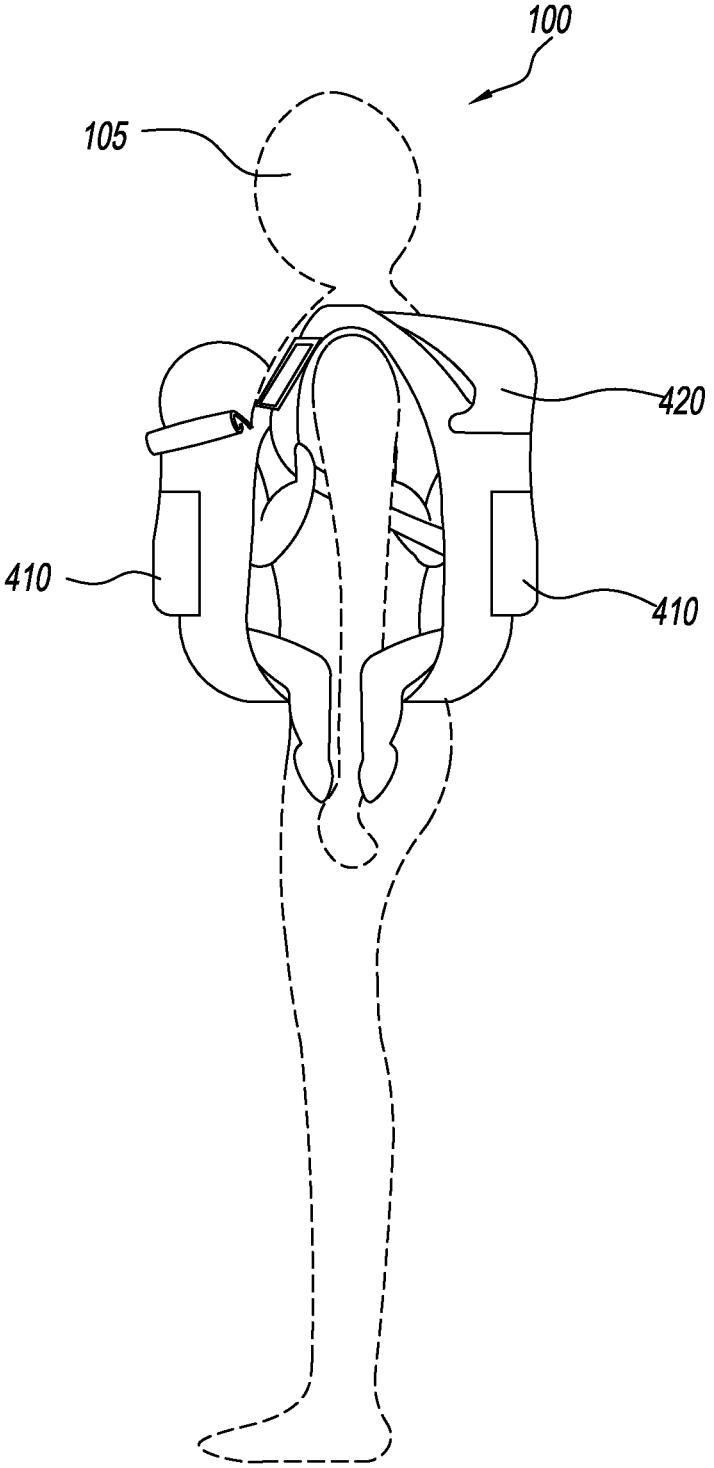
FIG. 11 depicts an example embodiment of a carrier in which the carrier pouches have pockets and hoods, and the first carrier pouch hood is in use.

If desired, head supports 420 may be removed entirely from the adult carrier 105 (e.g. by hook and loop or other fasteners) and placed within one of the pockets 410, folded and tucked into a hidden pocket between two layers of the carrier having an opening at the top of the pouch, folded flat against the inside or outside of the carrier 400, or rolled up and secured to the carrier 400 in some fashion as shown for example in FIG. 11.

FIG. 5 depicts an example embodiment of a carrier 500 with a waist support 510. The structured waist support 510 may allow the weight of the carried child or children to be dispersed more comfortably around a greater area of the hips of the carrying adult 105, facilitating the transport of larger children. The structured waist support may be made of a tough and fairly rigid material such as a sturdy rubber or foam, so the child's weight does not cause the belt to bow or bend. The sturdy material may be wrapped in soft fabric for comfort, and webbing and buckles may be attached for adjustability. Webbing alone is a flexible material that may be forced into uncomfortable positions against a wearer's body when a heavy child sits in the carrier. The less flexible and larger structured waist support resists deformation and presents a large surface area and soft material that spreads force comfortably over the wearer's body. There may be support sections 510, 515 corresponding to each of the second carrier pouch 110 and the first carrier pouch 120, such that the support sections 510 and 515 may have an interlocking fit for comfort of the adult carrier 105. Support sections 510 and 515 may independently adjust the size and shape of the corresponding second carrier pouch 110 and the first carrier pouch 120, respectively, by wrapping the fabric of the carrier pouches around the support sections 510, 515 as described above.

In alternative embodiments, the second support section 510 may be replaced by an ordinary (e.g. webbing) waist belt. In many embodiments, the rear carrier will be used for the larger child, if only because more weight can be borne on a wearer's back than in the front, all else equal, and therefore the structured waist support will be most helpful with the first carrier pouch. When the first carrier pouch is used alone in such embodiments, the structured waist support will go around the wearer's entire waist, whereas when used with the second carrier pouch the structured waist support will extend only part way around, the extent depending on how the waist is adjusted. Such embodiments may be more comfortable and/or affordable under some circumstances.

Figure 6:
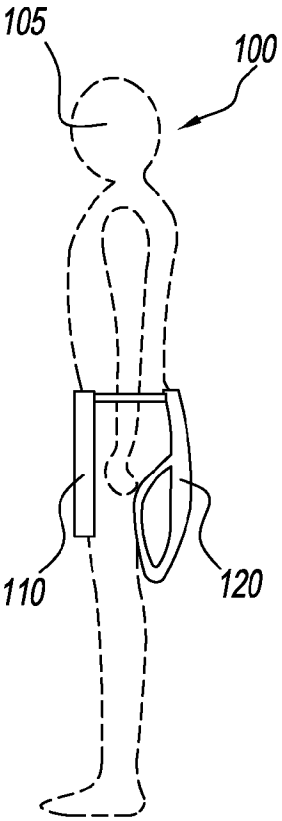
FIG. 6 depicts the example embodiment of the carrier of FIG. 1 in which the carrier pouches are unfastened and allowed to dangle.

FIG. 6 depicts an example embodiment of carrier 100 disposed along the waist of an adult wearer 105. Carrier 100 may not be in use, but is readily available to support a plurality of children if needed or desired. As depicted in FIG. 6, the second carrier pouch 110 may be disposed in front of the adult wearer 105, hanging below the waist of the adult wearer 105, while the first carrier pouch 120 may be disposed behind the adult 105, hanging below the waist of the adult wearer 105. The entire carrier hangs down from the waistband/waist support.

Figure 7:
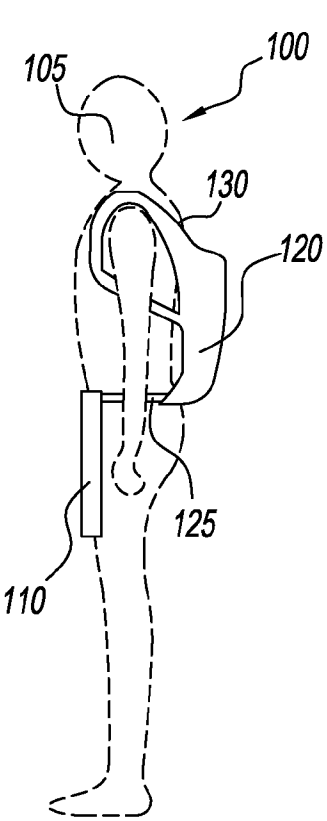
FIG. 7 depicts the example embodiment of the carrier of FIG. 1 in which the first carrier pouch does not contain a child and the second carrier pouch is unfastened and allowed to dangle.

FIG. 7 depicts an example embodiment of a carrier 100, wherein the first carrier pouch 120 is positioned to be in use behind and in between the waist and shoulders of the adult wearer 105, while the second carrier pouch 110 is not positioned to be in use (hanging below the waist of the adult). If the first carrier pouch 120 is positioned to be in use but a child is not disposed within the first carrier pouch 120, the first carrier pouch 120 may hold or store other items such as a purse, handbag, diaper bag, coat, etc. The shoulder straps 130 and/or the waist strap 125 may be adjusted based on the size and shape of the object(s) within the first carrier pouch 120.

Figure 8:
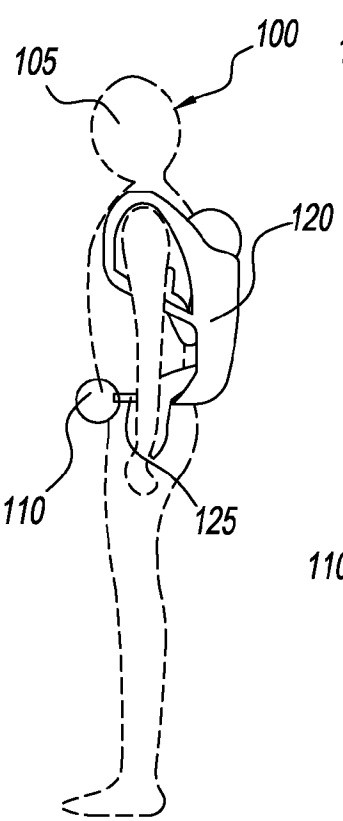
FIG. 8 depicts an example embodiment of a carrier in which the second carrier pouch is unfastened and rolled into a pouch.

FIG. 8 depicts an example embodiment of a carrier 100, wherein the first carrier pouch 120 is supporting a child and the second carrier pouch 110 is rolled and positioned in a tubular fashion, being horizontally aligned with the waist of the adult wearer 105. If the second carrier pouch 110 is not in use, it may be rolled up around the waist strap 125 or be tucked underneath the waist strap 125. In further example embodiments, if a child is not disposed within second carrier pouch 110, the second carrier pouch 110 may be buckled or clipped to the shoulder straps 130 to hold or store other items such as a purse, handbag, coat, diaper bag, etc.

Figure 10:
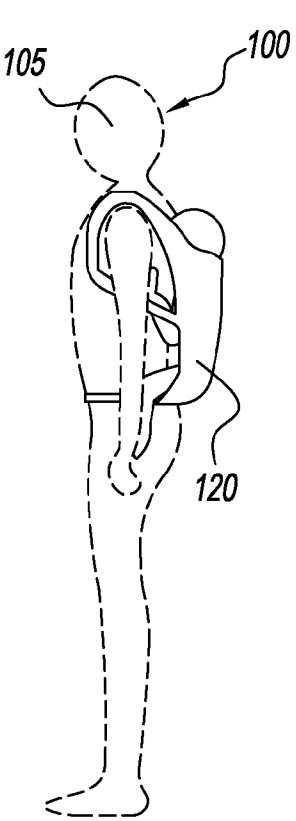
FIG. 10 depicts an example embodiment of a carrier in which the second carrier pouch has been removed.
Figure 9:
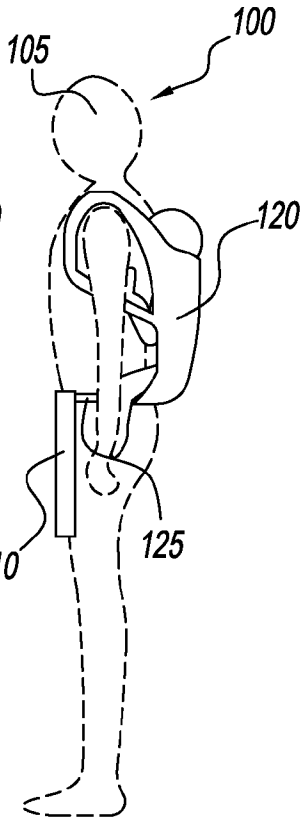
FIG. 9 depicts the example embodiment of the carrier of FIG. 1 in which the second carrier pouch is unfastened and allowed to dangle.

FIG. 9 depicts an example embodiment of carrier 100, where a child is disposed within first carrier pouch 120, while second carrier pouch 110 is hanging in front of adult wearer 105 below the waist of the adult wearer 105. However, in another example embodiment as shown in FIG. 10, the second carrier pouch 110 may be removed and taken off from the carrier 100. In this embodiment, the clip ends of the waistband of the first carrier pouch are attached to each other, instead of to clip ends of the waistband portion of the second carrier pouch. The single carrier can be worn on the wearer's back or front as shown in FIG. 13. FIG. 11 depicts an example embodiment of carrier 100 shown in FIG. 4 having head supports 420 and external pockets 410. In this embodiment, one headrest is up, supporting a child's head, and one is rolled down.

FIG. 12 depicts an example embodiment of carrier 100 where no back-supporting portion of first carrier pouch 320 forms a part of shoulder strap loops. To put on this carrier, the first carrier pouch 320 may be loaded while the wearer has it on his or her front. It is then removed with the baby still in it and moved to the back. The baby will not fall out because the child's weight gathers at the bottom of the carrier pouch 320 and the shoulder straps prevent the child from falling out the side of the carrier pouch 320. Once the baby is on the back, the second baby may be loaded into the second pouch on the front 310. In this embodiment, each carrier pouch is buckled separately to the shoulder straps 360, which is permanently connected only to the interior layer 1205 of the back carrier pouch 320. Thus, a child in the second carrier pouch 310 will pull on the shoulder straps 360 and on the interior layer 1205 of the first carrier pouch 320, but not on the outer layer 1210 of the first carrier pouch 320, and therefore will not exert any force on the occupant of the first carrier pouch 320. This allows two children of very different sizes (for example a toddler and a newborn) to be carried at the same time and in any order (front/back). It also prevents the second carrier pouch 310 from slumping down and away from the wearer if a weight is not inserted in the first carrier pouch 320.

In various embodiments, the inner layer may be a solid piece of fabric, long straps that extend down to the bottom of the carrier/waistband, or a strap that loops back to the shoulder strap. Since some such embodiments would lack the shoulder loops that help to keep a child securely inside the first carrier pouch, as shown for example in FIG. 11, some sort of seat belt or side buckle may be added to keep a child from sliding out sideways. The buckle may for example connect the two layers of fabric on the back together so the baby doesn't fall out the side of the carrier. Since children worn on the back are out of eye sight, more safety measures may be desired for carrier pouches intended for wearing on the back.

Figure 13A:
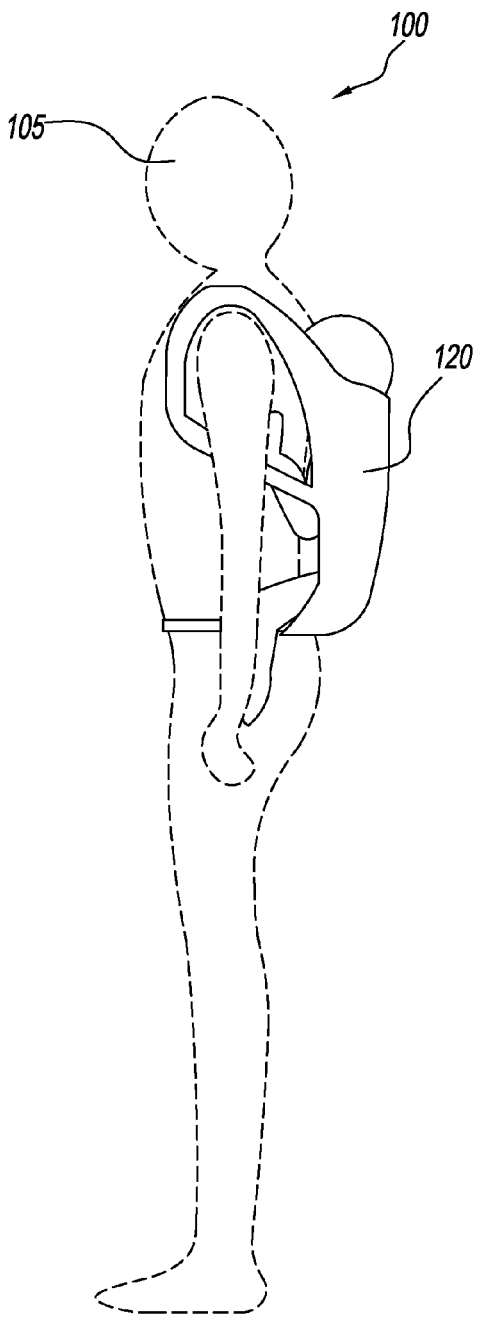
FIG. 13A-B depict an example embodiment of a carrier in which a first carrier pouch is worn alone on a wearer's front or back.
Figure 13B:
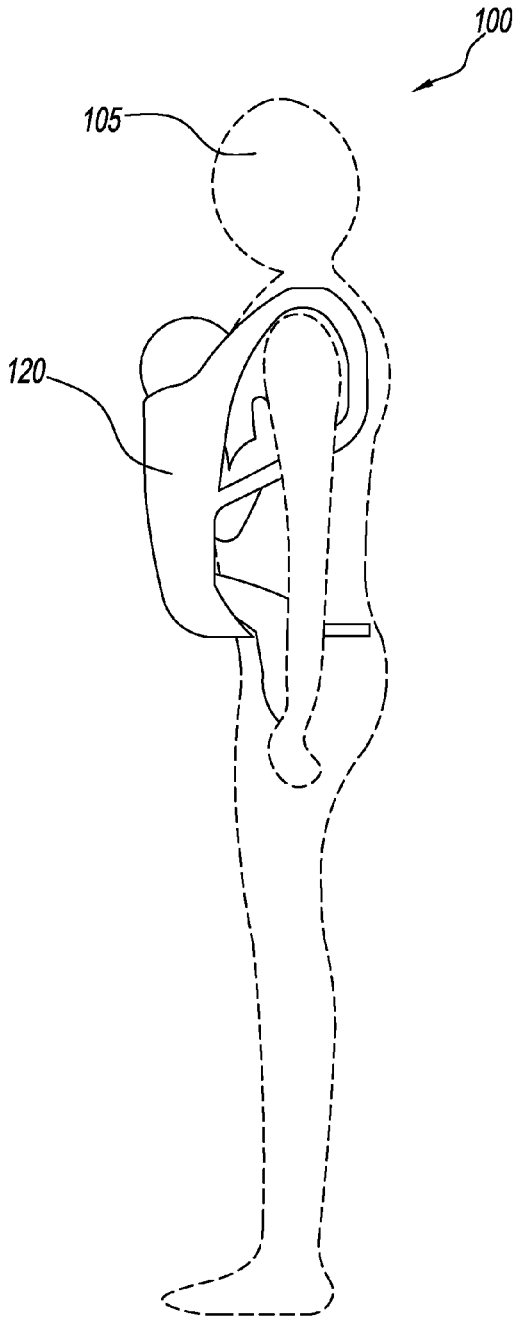

FIG. 13A-B depict an example embodiment of carrier 100 and shows that when wearing only one child, the first carrier pouch 120 may be worn on the front (FIG. 13A) or the back (FIG. 13B) and has the appearance of an ordinary one-child carrier, unlike convention multiple child carriers that have an awkward look and feel when only carrying one child.

Figure 14A:
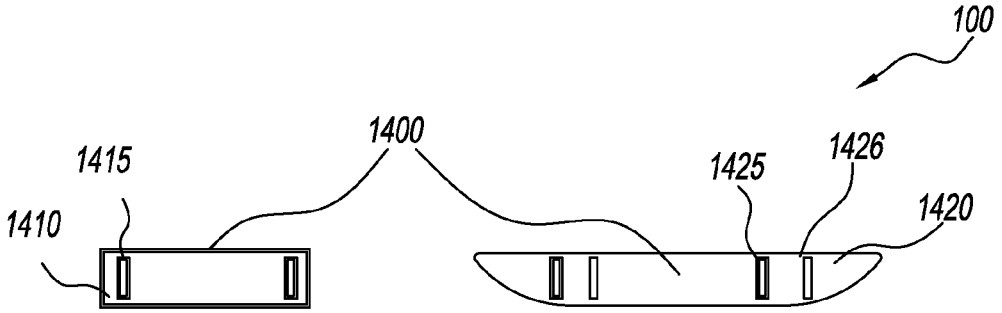
FIG. 14A-C depict the use of a support waist, in an example embodiment of a carrier.
Figure 14B:
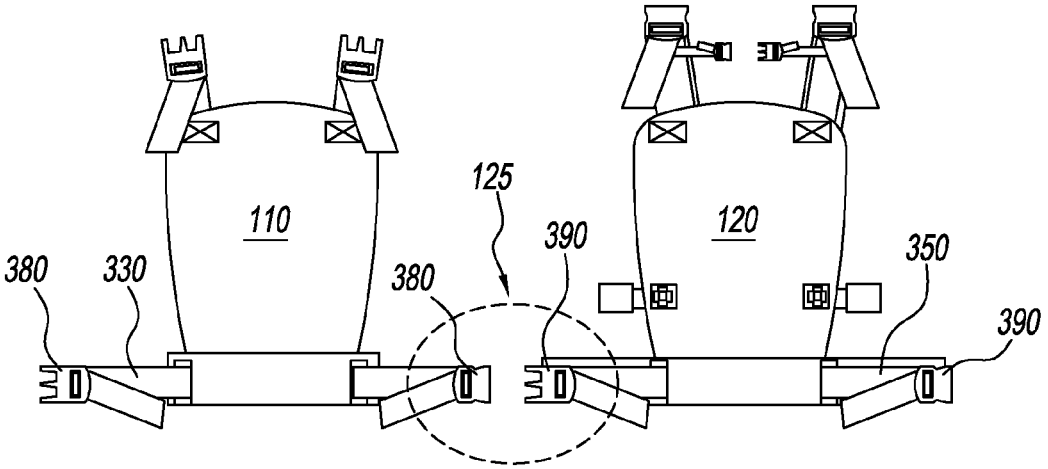
Figure 14C:
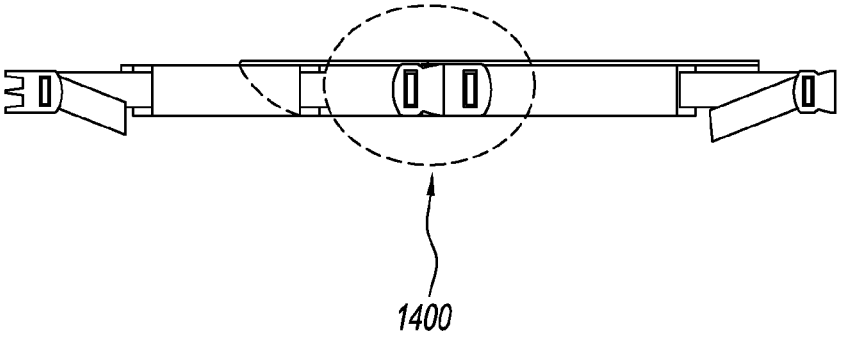

FIGS. 14A-C depict an example embodiment of carrier 100 with an optional structured support waist belt 1400. In this embodiment, the structured support belt is detachable to accommodate older children and their heavy weight without compromising effectiveness for infants. For infants, a structured support waist belt is not as effective because it is not needed for comfort of the wearer and is less flexible than an unstructured waist belt and thus does not cup as closely to the shape of an inserted infant, which is why other carriers have infant inserts. By having an optional detachable waist belt 1400, it allows for the carrier 100 to expand as the children age without any inserts and without changing carriers. The structured support belt is wider and may be padded, to spread the child's weight over a larger portion of the wearer's hips and increase comfort for large children. The structured support waist belt 1400 has first and second sections 1420, 1410 respectively, shown separate from waist belt 125 in FIG. 14A. The first portion has slits 1425, 1426 and the second portion has slits 1415, through which the waistband portions 330, 350 can be threaded for attachment. The first waistband portion 350 is threaded through the inner slits 1425 of the first section and the clips 380 of the second waistband portion are threaded through the outer slits 1426 of the first section before clips 380 and 390 are fastened together in FIG. 14B. When the waistband portions 330, 350 are fastened together as shown in FIG. 14C, the structured support waist belt sections overlap and are secured together to form structured support waist belt 1400. First structured support waist belt section 1420 may also be used alone when the first carrier pouch is used alone, with the clips 390 connected to one another to form the waist belt.

FIG. 15 depicts an example embodiment of carrier 100 and shows an embodiment with a toddler in the back and a baby in the front. It shows that the two pouches 110 and 120 can be two independent sizes.

Figure 16A:
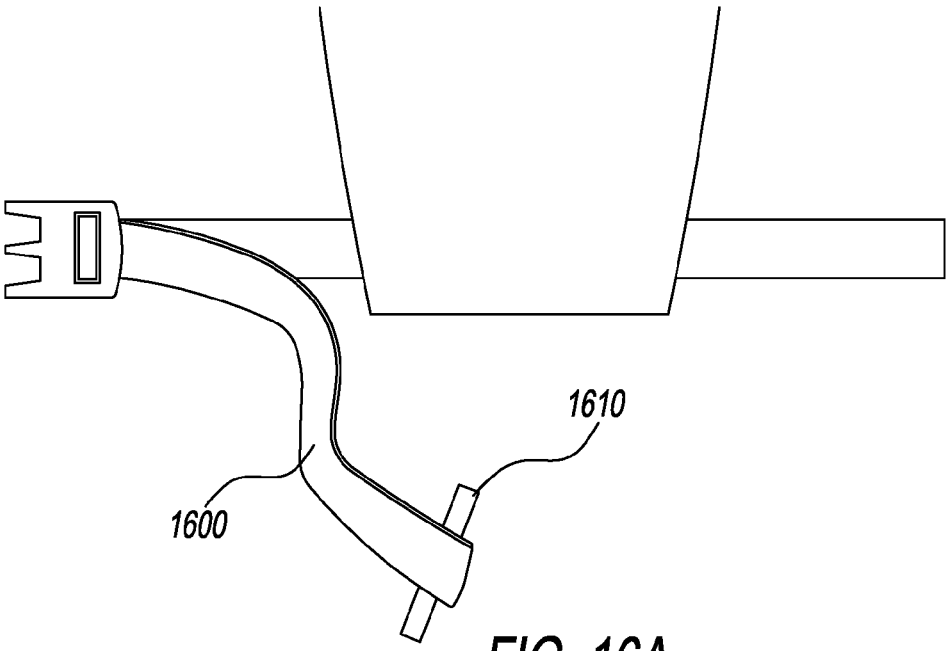
FIG. 16A-C depict an example embodiment of a waistband for a carrier having roll-away excess webbing.
Figure 16B:
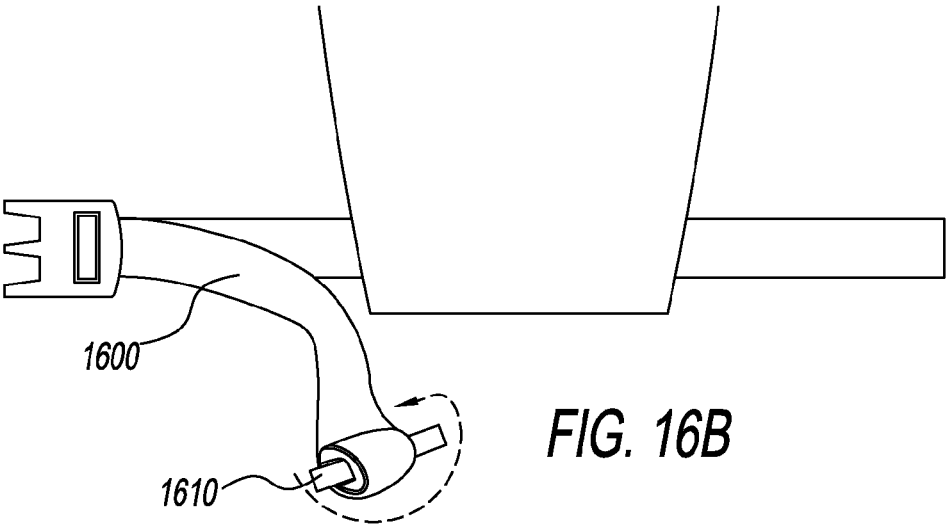
Figure 16C:
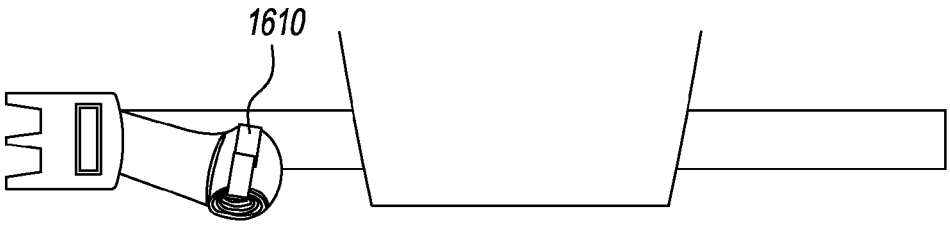

FIGS. 16A-C depict an example embodiment of carrier 100 having straps where an excess length of webbing 1600 (or whatever material the straps are made from) can be rolled up and secured to keep it out of the wearer's way and improve the carrier's appearance. Here, the waist strap includes a piece of hook and loop fastener or elastic 1610 at its tip. The excess material 1600 can be rolled up as shown and then secured by the hook and loop fastener or elastic 1610. FIG. 16A shows the excess material 1600 with piece of hook and loop fastener 1610 loose, FIG. 16B shows the excess material 1600 partially rolled, and FIG. 16C shows the excess webbing 1610 rolled and secured by hook and loop fastener piece 1610. This is particularly useful for small/petite wearers, for whom there is likely to be a significant amount of excess length. Although only the waist strap is shown, the shoulder straps, etc. can have the same configuration.

FIGS. 17A-L depict a user step-by-step putting on an embodiment of the carrier and inserting children in the first and second carrier pouches. To first place a child into the carrier pouch to be worn on the wearer's back, the wearer first puts on one shoulder strap and places a child on the wearer's side hip (FIG. 17A), placing one of the child's legs into the first carrier pouch. Next, the wearer pushes the child further into the carrier pouch and grasps the child's inserted leg with one hand (FIG. 17B), pulling it out the other side of the carrier pouch while supporting the other side of the child with the other hand. Next the child is fully inserted in the carrier pouch with legs extending out of the carrier pouch on each side (FIG. 17C). The wearer then reaches back with one arm (FIG. 17D) and slips the other shoulder strap over that arm and then over that shoulder (FIG. 17E). The child is now secured in the first carrier pouch (FIG. 17F). Next, the wearer lifts one side of the second carrier pouch (FIG. 17G) and attaches one side of the second carrier pouch to the shoulder straps (FIG. 17H). The wearer then inserts a second child in the opposite side of the second carrier pouch (FIG. 17I) until one leg extends out the other side of the carrier pouch. The user grasps that leg with one hand and the other side of the child with the other hand and fully inserts the child into the second carrier pouch (FIG. 17J), then attaches the other side of the second carrier pouch to the shoulder straps (FIG. 17K) to secure the child in the second carrier pouch. Both children are now securely loaded into the carrier (FIG. 17L).

FIG. 18 depicts the shoulder straps of an example embodiment of carrier 100. The shoulder straps 130 have an unpadded portion 1820 connected to carrier 320 and a padded portion 1810 with a slight curve 1830, and all the buckles 1850, 1860, 1870 necessary to make the carrier work and uniquely adjust to fit the wearer's build and the build of two inserted children are shown. This shoulder curvature 1830 inwards towards the center of a wearer in front is distinctive from existing twin carriers. The curves mold around the wearer's shoulders, and the shoulder straps narrow near the chest. Padding at the bottom front that is too thick would be uncomfortable for a woman, especially a big-chested woman, and would cause chafing under the arms. Also, the curve allows for the chest/sternum strap to be placed in the proper position on the adult's chest. If the shoulder straps were straight and the sternum strap was buckled, the sternum strap could pull the lower part of the shoulder straps onto the chest of the wearer, which might be uncomfortable, especially where the bottoms of the shoulder straps have plastic pieces that could be irritating to the wearer. With a curved design, the sternum strap pulls on the shoulder straps but the lower strap still remains on the sides of the chest. In the back, the shoulders start out straight to keep the carrier straight and centered.

The straps may be made of gymnastics rubber (closed cell foam) instead of open cell foam, which is commonly used for existing carriers. Shoulder straps three inches wide and ¾" thick may be used, and with that thickness and material can tolerate fifty pounds of compression per square inch. With two such straps, the carrier can easily support 100 lbs on the shoulders, which greatly exceeds any realistic load. For reduced bulk and manufacturing expense, the shoulder straps may be ½" thick and 2.5" or 2.75" wide. Given the dual shoulder straps and the fact that much of the weight is borne at the wearer's hips, a thickness of ¼" is sufficient to support a 50-pound load in the carrier pouches. However, to maintain a factor of safety in case of misuse or overloading, thicker shoulder straps may be used.

Existing twin carriers use much smaller straps to reduce bulk due to inefficient designs, and are therefore not safe for holding larger children. The thickness of the straps in embodiments of the present invention provides more surface area over which weight is distributed, hence allowing the wearer to carry a heavier load. Additionally, other carriers use open cell foam that compresses significantly more than closed cell foam under increased weight. Open cell foam also absorbs water, so it cannot stand repeated washings and breaks down over time. Closed cell foam does not absorb water or break down as quickly as open cell foam, extending the life of the straps by decades.

Chest straps 365 are adjustable and can slide along adjustment strap 1840 on buckle 1850. In other embodiments, various alternatives may be substituted for adjustment strap 1840 and/or buckle 1850. For example, instead of buckle 1850 sliding along strap 1840, a clip may slide along a rigid rail or the like. Ordinarily there is a means for temporarily securing the adjustment mechanism in a preferred position until readjustment is desired. Any known means of adjustment may be used. Buckles 1860, 1870 allow for further adjustment of shoulder strap length and therefore the shape and fit of connected carrier 320. Straps 340 loop around and connect back to carrier 320. When a baby falls asleep, he or she can end up sleeping on the chest strap if the child does not have his or her head to one side or the other. For that reason, the chest strap may have a simple padded cover, which may for example be two square pieces of fabric with padding in between and hook-and-loop or snap fasteners on either side to secure the fabric and padding to the chest strap. It may be a permanent attachment or removable accessory.

Figure 19A:
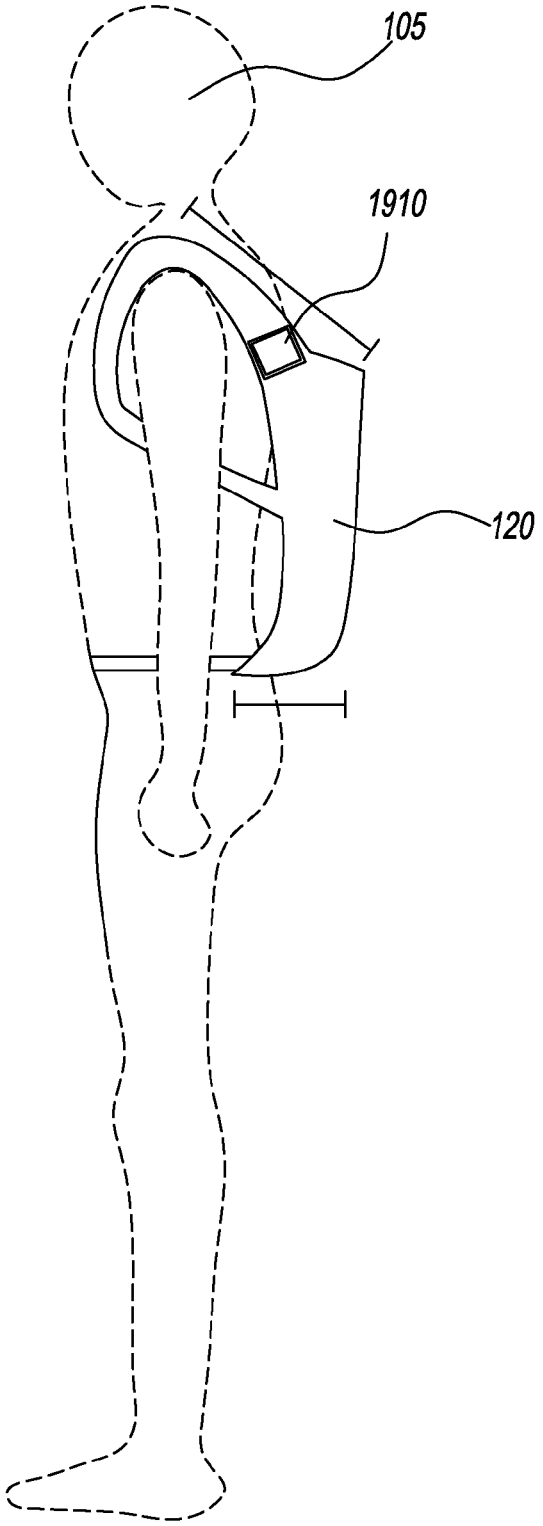
FIG. 19A-B depict adjustment of the top of the shoulder strap of the first carrier pouch in an example embodiment of a carrier.
Figure 19B:
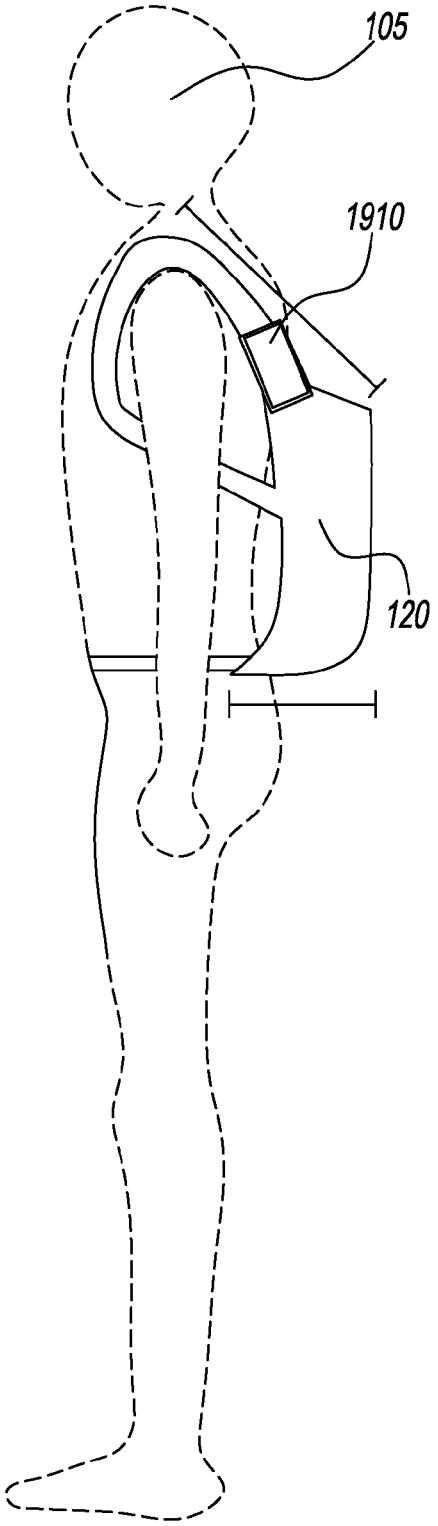

FIGS. 19A-B depict the first carrier pouch of an example embodiment of carrier 100, having adjustable straps 1910 at the top of the shoulder strap in order to make the strap longer or shorter without affecting the proper placement of the first carrier pouch. This is important for petite adults to allow the shoulder straps to fall in the optimal comfort zone and still have the top of the back carrier positioned properly somewhere around the shoulder blades. With a shorter adjustable strap 1910 (FIG. 19A), the top of the carrier pouch 120 is higher and the back of the carrier pouch 120 is closer to the wearer's body. When the adjustable strap 1910 is lengthened (FIG. 19B), the top of the carrier pouch 120 is lower and the back of the carrier pouch 120 is farther from the wearer's body. In embodiments, the shoulder straps can also be adjusted where they intersect the carrier below.

Figure 20A:
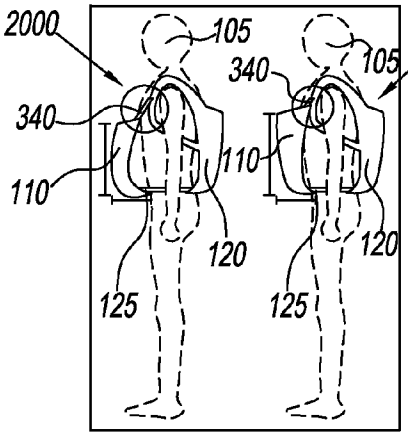
FIG. 20A-F depict an example embodiment of a carrier and various ways it can be adjusted to properly fit the wearer and children
Figure 20B:
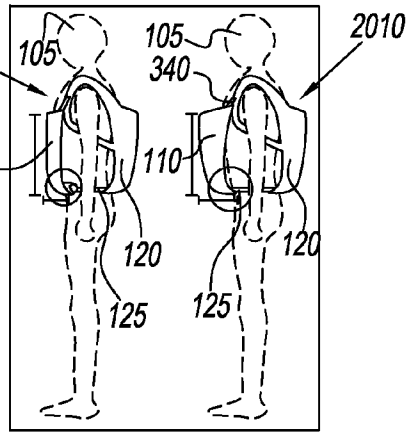
Figure 20C:
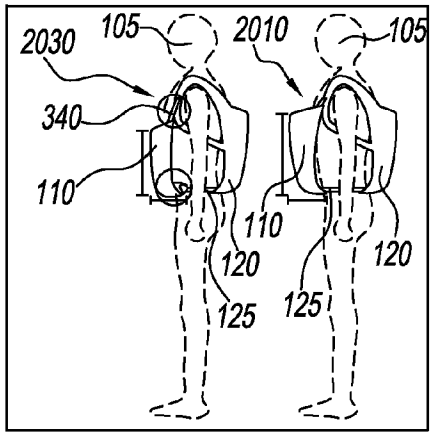
Figure 20D:
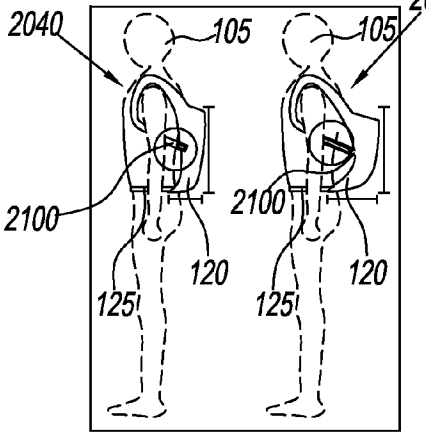
Figure 20E:
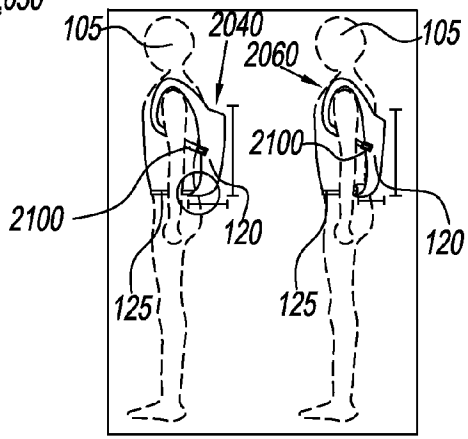
Figure 20F:
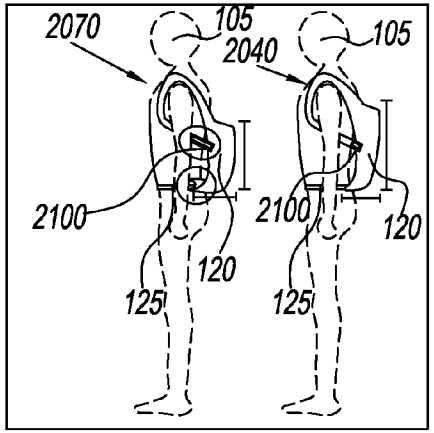

FIGS. 20A-F depict an example embodiment of carrier 100 and the various ways it can be adjusted to properly fit the wearer and children, including adjusting shoulder straps from the bottom, like a backpack. This lengthens the straps, but moves the placement of the first carrier. For petite adults, this moves the carrier closer and higher to the body, which may result in a snugger and therefore safer and more comfortable fit of the back child against the wearer. Carrier 2010 has unadjusted first and second carrier pouches 120, 110, carrier 2040 has an unadjusted first carrier pouch 120. FIG. 20A shows that carrier 2000 has been adjusted to lengthen adjustable top straps 340, reducing the height of the second carrier pouch and causing the middle to bow out farther from the wearer 105 and the bottom to slump farther below the waist band 125. FIG. 20B shows that carrier 2020 has been adjusted to wrap a portion of the second carrier pouch 110 around waist band 125, shortening the second carrier pouch 110 and drawing it closer to the wearer 105. FIG. 20C shows that carrier 2030 has been adjusted to lengthen adjustable top straps 340 and roll up waist band 125, lowering the height of the second carrier pouch 110 while leaving the distance from the wearer 105 essentially unchanged. FIG. 20D shows that carrier 2050 has been adjusted to lengthen shoulder straps 130 at a bottom connection 2100 to the first carrier pouch 120, allowing the first carrier pouch 120 to move significantly farther from the wearer 105 without lowering the height much. FIG. 20E shows that carrier 2060 has been adjusted to wrap a portion of the first carrier pouch 120 around waist band 125, shortening the first carrier pouch 120 and drawing it closer to the wearer 105. FIG. 20F shows that carrier 2070 has been adjusted to lengthen shoulder straps 130 at a bottom connection 2100 to the first carrier pouch 120, and to wrap a portion of the first carrier pouch 120 around waist band 125, causing the height of the first carrier pouch 120 to be reduced and allowing the first carrier pouch 120 to extend farther from the wearer 105.

Figure 21:
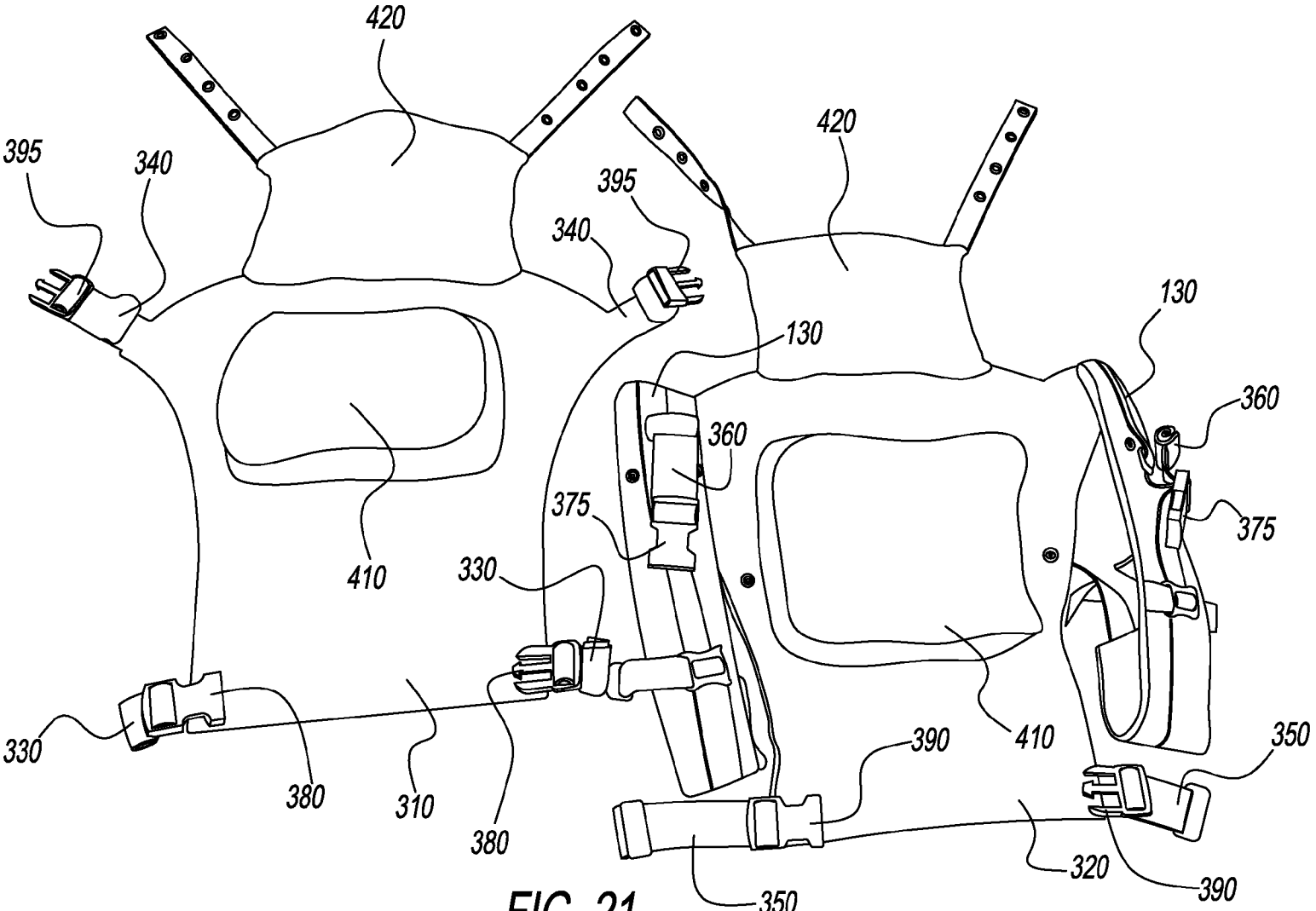
FIG. 21 depicts an example embodiment of a carrier with hoods and pockets, laid flat.

FIG. 21 depicts an embodiment of a carrier with front and back pouches 320, 310 detached and laid flat, viewed from the back. The pouches 320, 310 have pockets 410 and headrests 420 with snaps.

FIG. 22 depicts an embodiment of a carrier having a safety belt on the second carrier pouch. In various embodiments, the safety belt or strap can be located on the side of the carrier pouch, connected from the second carrier pouch to an attachment point on the shoulder straps or first carrier pouch to block a child from slipping out the side of the second carrier pouch, or may extend across the width of the second carrier pouch, from one side to the other, like a seat belt, as shown in FIG. 22. A safety belt or safety strap provides additional safety when the second carrier pouch is worn on the front with a small child, and also makes it safer to use the second carrier pouch worn on the back of a wearer.

FIG. 22 depicts an embodiment of a safety belt 2200 on the second carrier pouch 310. Safety belt 2200 is a horizontal waist belt made out of stretchy fabric. In another embodiment, the safety belt may be a tick seat belt with a buckle. Safety belt 2200 supports the baby's waist from under the arm pits down to the hips while the baby's legs remain exposed. The stretchy fabric belt 2200 is shown with buckles 2202, but in embodiments may be sewn (permanently attached) to each inside edge of the second carrier pouch. The wearer inserts a child between the stretchy material and second carrier pouch and puts on the carrier as normal. For a larger child who does not need the safety belt, the child can simply be inserted between the wearer and the stretchy material, which will remain tight against the second carrier pouch.

For buckle seat belt embodiments, the belt may be fabric attached on only one side (such as near the outside pocket on the front of the second carrier pouch) that wraps around a child in the second carrier pouch, between the wearer and the child, and clips to a buckle or strong snaps on the other side of the second carrier pouch on the outside. The wearer would put the baby in as normal, then bring the seat belt around the baby to buckle. The wearer would need to slide the buckle between the baby's stomach and the wearer's stomach. Many other safety belt and safety strap embodiments are possible.

Figure 23:
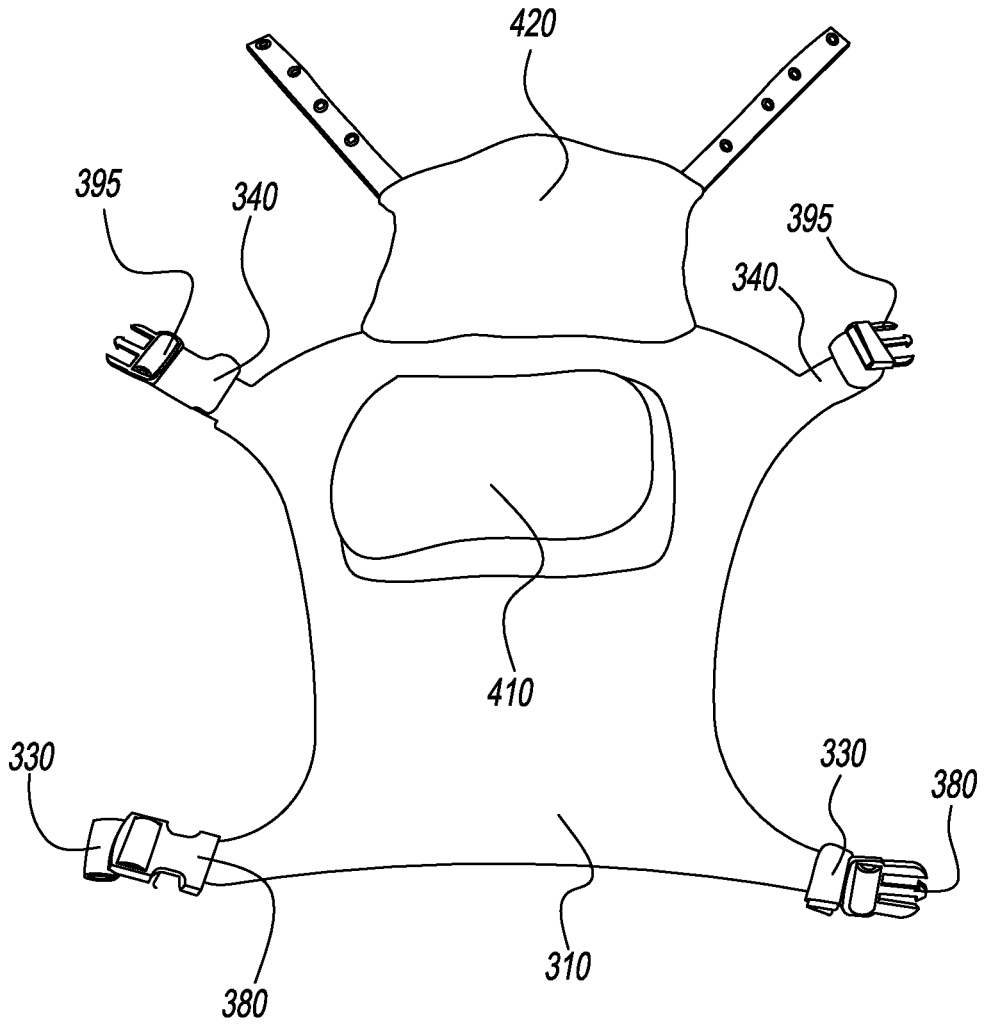
FIG. 23 depicts an embodiment of a carrier pouch having a width that decreases above its bottom.

FIG. 23 depicts an embodiment of a carrier pouch having a width that decreases above its bottom, such that rolling the carrier pouch up around a waist belt from its bottom decreases the effective bottom width for use with small babies.

Figure 24:
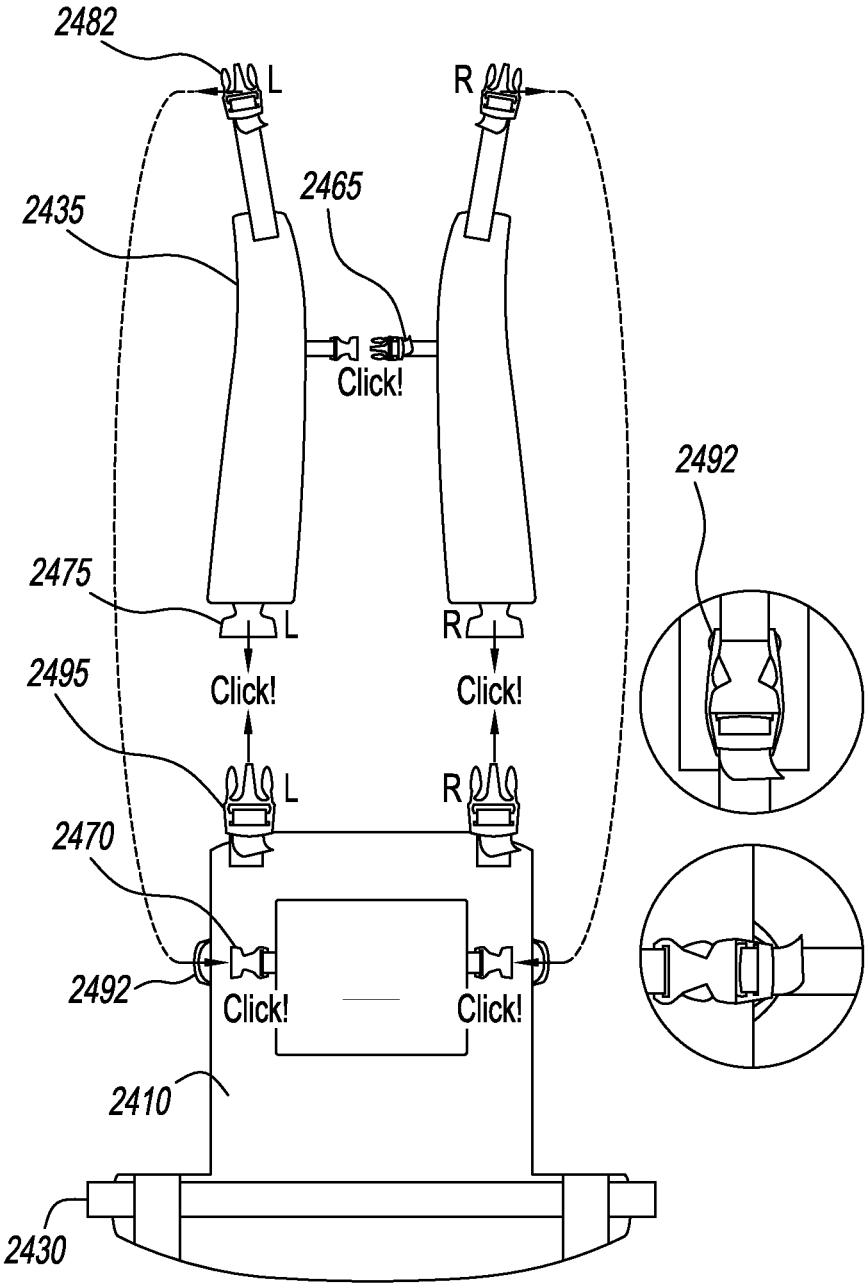
FIG. 24 depicts an embodiment of a second set of shoulder straps and its connection to a carrier portion.

FIG. 24 depicts an embodiment of a second set of shoulder straps 2435 and its connection to a second carrier portion 2410. The second set of shoulder straps 2435 is similar to the shoulder straps shown in e.g. FIG. 12, but with the permanently attached carrier portion removed. In this embodiment, the second shoulder straps include a chest strap 2465, female clip halves 2475 for connecting to the top of a carrier portion, and male clip halves 2482 for connecting to the sides of a carrier portion. In this embodiment, the second shoulder straps 2435 do not form a loop for going around a wearer's shoulders without an attached carrier portion. Carrier portion 2410 is similar to the second carrier portion shown in e.g. FIG. 12, but with the addition of side female clip halves 2470 which are comparable to adjustment clips 370 of the first carrier portion (and which alternatively can be D-rings, etc.) and attach to male clip halves 2482. The carrier portion 2410 includes waist 2430 and male clip halves 2495 for connecting with female clip halves 2475 of the shoulder straps 2430. When the second shoulder straps 2435 and carrier portion 2410 are attached with clips 2482, 2470, 2495, 2475, shoulder loops are formed by the combination of the clips, straps, and the carrier portion fabric between the clips 2470, 2495.

Also shown in this embodiment are safety elastic loops 2492. Male clip halves 2482, 2495 are inserted through these elastic loops when securing them to female clip halves 2470, 2475, and secure the male clip halves independently from the female clip halves in case of, for example, female clip failure. These elastic loops do not provide a rigid or stable connection, but prevent catastrophic failure (e.g. the carrier falling apart and a child falling from the carrier) in the event of clip failure.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments. While the embodiments may be illustrated by using a particular embodiment, this is not and does not limit the invention to any particular embodiment and a person of ordinary skill in the art will recognize that additional embodiments are readily understandable and are a part of the example embodiments.

It will also be appreciated that one or more of the elements depicted in the drawings/figures can also be implemented in a more separated or integrated manner, or even removed or rendered as inoperable in certain cases, as is useful in accordance with a particular application. The invention encompasses every possible combination of the various features of each embodiment disclosed. Additionally, any signal arrows in the drawings/figures should be considered only as exemplary, and not limiting, unless otherwise specifically noted.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

I claim:

1. A child carrier system for simultaneously carrying two children of the same or different sizes, the carrying being by only a first person in a first configuration and the carrying being by the first person and a second person in a second configuration, the system comprising:

a first child carrier portion comprising a first carrier pouch attached at its bottom to a waist support;

a second child carrier portion comprising a second carrier pouch attached at its bottom to the waist support in the first configuration;

shoulder straps; and second shoulder straps independent of any child carrier portions in the first configuration and independent of any waist support such that the second shoulder straps are not directly connected to any waist support in either the first or second configuration;

wherein the first child carrier portion and the second child carrier portion are configured to be secured to and between the shoulder straps and to be directly opposite one another when both are secured to the shoulder straps in the first configuration;

wherein at least one of the first child carrier pouch and the second child carrier pouch is configured to extend behind the shoulder straps, such that a heavy weight in the opposite child carrier that presses the shoulder straps tightly against a wearer does not compress a child therein against the wearer in the first configuration; and wherein each of the first and second carrier pouches is curved towards a wearer to prevent a child inserted therein from facing away from the wearer and is configured to hold a child in a seated straddle position, wherein the second child carrier portion is configured for complete removal from the shoulder straps; and wherein the second child carrier portion is configured for attachment to the second shoulder straps to create an independent child carrier worn by the second person in the second configuration.

2. The child carrier system of claim 1, wherein the first carrier portion is configured to be secured to the second shoulder straps.

3. The child carrier system of claim 2, wherein the second shoulder straps are configured to be secured to the first carrier portion and the second carrier portion simultaneously.

4. The child carrier system of claim 1, wherein the shoulder straps and second shoulder straps are identical.

5. The child carrier system of claim 1, wherein the first child carrier portion is permanently affixed to the shoulder straps and thus cannot be removed from the shoulder straps and attached to the second shoulder straps.

6. The child carrier system of claim 1, wherein the second shoulder straps together with a secured second carrier portion and/or first carrier portion form complete loops.

7. The child carrier system of claim 1, wherein each of the first and second carrier pouches comprises a flexible material that causes a child inserted therein to sit low against the waist support and that presses against the back of the child to press the child against the wearer when a wearer has the waist support secured around the wearer's waist and the shoulder straps over the wearer's shoulders, thereby directing the child's weight to the wearer's hips.

8. The child carrier system of claim 1, wherein the waist support comprises a first waist support section attached to the bottom of the first carrier pouch and a second waist support section attached to the bottom of the second carrier pouch; and wherein the first waist support section and the second waist support section are configured to be fastened together to form a single, adjustable waist band;

wherein the first carrier pouch and first waist support section are configured for reducing the effective size of the first carrier pouch, independently of the second carrier pouch, by wrapping a portion of the first carrier pouch around the first waist support section;

wherein the second carrier pouch and second waist support section are configured for reducing the effective size of the second carrier pouch, independently of the first carrier pouch, by wrapping a portion of the second carrier pouch around the second waist support section.

9. The child carrier system of claim 8, wherein the first waist support section comprises ends configured to be secured to each other to form an adjustable waist band without fastening to the second waist support section.

10. The child carrier system of claim 1, wherein the first child carrier portion is configured such that, when worn on a wearer, an opening is formed on either side of the first child carrier portion between the wearer's body, the first carrier pouch, the first waist support section, and the shoulder straps, through which the limbs of a child inserted in the first carrier pouch can extend, and wherein the second child carrier portion is configured such that, when worn on a wearer, an opening is formed on either side of the second child carrier portion between the wearer's body, the second carrier pouch, the second waist support section, and the shoulder straps, through which the limbs of a child inserted in the second carrier pouch can extend.

11. The child carrier system of claim 1, wherein the first and second carrier pouches are configured so that no portion of the first or second carrier pouches comes between the torso of a child inserted into one of the carrier pouches and a wearer of the first and second child carrier portions.

12. The child carrier system of claim 1, wherein each carrier pouch is configured to hold a child of an intended size therein in a seated straddle position.

13. The child carrier system of claim 12, wherein one or more of the carrier pouches comprises a mechanism for reducing or increasing its effective bottom width.

14. The child carrier system of claim 13, wherein the mechanism comprises a narrowing of the pouch from its bottom to a point above its bottom.

15. The child carrier system of claim 1, wherein the shoulder straps and first carrier pouch together form loops configured to be worn over the wearer's shoulders and the shoulder straps present a barrier to a child falling out the side of the first carrier pouch.

16. The child carrier system of claim 1, wherein the first and second carrier pouches are flexible enough that the rear end of a child inserted therein rests below the top level of the waist support sections.

17. The child carrier system of claim 1, wherein each of the first child carrier pouch and the second child carrier pouch is configured to extend behind the shoulder straps, such that a heavy weight in the opposite child carrier that presses the shoulder straps tightly against a wearer does not compress a child therein against the wearer in the first configuration.

18. The child carrier system of claim 1, further comprising a safety belt releasably secured across at least one of the carrier pouches to prevent a child from falling out of the at least one of the carrier pouches.

19. A child carrier method for carrying two children of the same or different sizes simultaneously, comprising:

inserting a user's arms in shoulder straps and securing the shoulder straps to the user's body;

securing a first child carrier portion and a second child carrier portion to the shoulder straps;

inserting a first child of a first size in the first child carrier portion and a second child of a second size in the second child carrier portion, wherein the first size and the second size differ by between five and twenty pounds, thereby defining a first configuration;

removing the second child from the second child carrier portion;

removing the second child carrier portion from the shoulder straps; providing second shoulder straps independent of any child carrier portion in the first configuration and not directly connected to any waist support in the first configuration and inserting a second user's arms in second shoulder straps and securing the second shoulder straps to the second user's body securing the second child carrier portion to the second shoulder straps; and inserting the second child into the second child carrier portion, thereby defining a second configuration wherein the second shoulder straps are not directly connected to any waist support.

* * * * *